US005271660A

United States Patent [19]

LaPointe et al.

[11] Patent Number: 5,271,660

[45] Date of Patent: Dec. 21, 1993

[54] RECLINING SOFA

[75] Inventors: Larry P. LaPointe, Temperance; Karl J. Komorowski, Petersburg; Jonathan R. Saul, LaSalle, all of Mich.

[73] Assignee: La-Z-Boy Chair Co., Monroe, Mich.

[21] Appl. No.: 740,980

[22] Filed: Aug. 6, 1991

Related U.S. Application Data

[63] Continuation-in-part of Ser. No. 600,181, Oct. 18, 1990, Pat. No. 5,147,108.

[51] Int. Cl.[5] ..... A47C 1/02

[52] U.S. Cl. ..... 297/85; 297/434; 297/68; 297/423.3

[58] Field of Search ..... 297/83, 84, 85, 68, 297/89, 69, 70, 434, 436, 87, 71

[56] References Cited

U.S. PATENT DOCUMENTS

| | | | |
|---|---|---|---|
| 745,706 | 12/1903 | Wilsdorf | 297/434 X |
| 1,048,306 | 12/1912 | Greilick . | |
| 2,588,574 | 3/1952 | Rizzolo | 297/87 X |
| 2,677,412 | 5/1954 | Thomas . | |
| 2,918,110 | 12/1959 | Schliephacke . | |
| 2,918,111 | 12/1959 | Schliephacke . | |
| 2,919,745 | 1/1960 | Schliephacke . | |
| 3,014,758 | 12/1961 | Schliephacke | 297/89 |
| 3,033,611 | 5/1962 | Schliephacke . | |
| 3,096,121 | 7/1963 | Knabusch et al. . | |
| 3,099,487 | 7/1963 | Knabusch et al. | 297/429 |
| 3,400,975 | 9/1968 | Rogers, Jr. | 297/85 X |
| 3,537,747 | 11/1970 | Rogers, Jr. | 297/85 |
| 3,567,280 | 3/1971 | Bradshaw | 297/318 |
| 3,869,169 | 3/1975 | Johnson et al. | 297/84 |
| 3,869,170 | 3/1975 | James et al. | 297/270 |
| 3,869,172 | 3/1975 | James et al. | 297/316 |
| 3,874,724 | 4/1975 | Re | 297/88 |
| 4,071,275 | 1/1978 | Rogers, Jr. | 297/85 |
| 4,072,342 | 2/1978 | Johnson et al. | 297/84 |
| 4,179,157 | 12/1979 | Shoemaker et al. | 297/83 |
| 4,226,469 | 10/1980 | Rogers, Jr. et al. | 297/85 |
| 4,291,913 | 9/1981 | Kowalski | 297/89 |
| 4,332,417 | 6/1982 | Mizelle | 297/329 |
| 4,346,933 | 8/1982 | Jacobs | 297/89 |
| 4,350,387 | 9/1982 | Rogers, Jr. | 297/85 |
| 4,364,603 | 12/1982 | Johnson | 297/84 |
| 4,367,895 | 1/1983 | Pacitti et al. | 297/83 X |
| 4,423,903 | 1/1984 | Gerth | 297/89 |
| 4,494,793 | 1/1985 | Rogers, Jr. | 297/85 |
| 4,506,926 | 3/1985 | Griggs, Jr. | 297/83 |
| 4,668,009 | 5/1987 | Talley et al. | 297/85 |
| 4,690,454 | 9/1987 | Mizelle | 297/89 |
| 4,740,031 | 4/1988 | Rogers, Jr. | 297/85 |
| 4,844,536 | 7/1989 | Mizelle | 297/68 |
| 5,011,220 | 4/1991 | LaPointe | 297/89 |
| 5,056,862 | 10/1991 | May et al. | 297/68 X |
| 5,064,244 | 11/1991 | Sproule | 297/83 |

*Primary Examiner*—Kenneth J. Dorner
*Assistant Examiner*—Milton Nelson, Jr.
*Attorney, Agent, or Firm*—Harness, Dickey & Pierce

[57] ABSTRACT

A recliner mechanism incorporating a push-button assist apparatus for initiating movement of a leg rest assembly from a retracted position to an extended position. A pair of C-shaped toggle links are fixedly coupled to a drive rod and each include coil springs, the coil springs further being coupled to an adjustable tensioning mechanism to enable the tension of both coil springs to be adjusted. A pair of tracks are provided for enabling a portion of the recliner mechanism to move forwardly upon actuation of the push-button assist apparatus. An adjustable stop bracket is provided for limiting the forward travel of the recliner mechanism along the tracks to thereby adjustably control the height and inclination angle of the leg rest member.

37 Claims, 16 Drawing Sheets

RECLINING SOFA

CROSS-REFERENCE TO RELATED APPLICATIONS

This is a continuation-in-part of U.S. patent application Ser. No. 07/600,181, filed Oct. 18, 1990, now U.S. Pat. No. 5,147,108 and entitled "Reclining Sofa".

BACKGROUND OF THE INVENTION

The present invention relates to furniture and, more particularly, to an improved reclining mechanism for articles of furniture such as chairs, sofas and loveseats.

Conventionally, recliner type seating units (i.e. chairs, sofas, loveseats and the like), generally require a predetermined distance between an adjacent wall surface and the seat back to avoid contact therebetween during reclined operation. In addition, loose seat cushions are not generally used in most recliner type seating units due to the height requirements associated with operably supporting the mechanical recliner mechanism under the seat.

Reclining mechanisms typically generate a relatively large amount of frictional drag which must be overcome for smooth movement between an "upright" and a "tilted" position. In particular, lighter weight seat occupants must normally exert a deliberate leveraged thrust or force, in addition to pulling the actuator lever, for completely extending the leg rest and moving the seat section to its "tilted" position. Moreover, it is often difficult for the seat occupant to return to the upright position from the "tilted" or a fully "reclined" position due to the height and the upward angular tilt of the seat relative to the reclined seat back. As such, the occupant must exert a relatively large and deliberate leveraged force to return the reclined seat section to the full upright position. Another drawback associated with recliners is that the leg rest assembly cannot be retracted to its stowed position from an extended elevated position until after the seat occupant has completely returned the seat section to its fully upright position.

As is known, virtually all traditional recliner type seating units require the seat occupant to either forcibly urge a portion of the seating section forwardly (i.e. by pulling on an arm portion of the chair), or manually move some type of actuating lever to initiate movement of the leg rest assembly from a retracted position toward an extended and elevated position. While most recliner type seating units have proven to be generally successful, it nevertheless would be desirable to permit the seat occupant to deliberately initiate movement of the let rest assembly toward its extended position with virtually no physical effort. Such a leg rest release arrangement would be particularly advantageous for elderly or handicapped persons who typically have difficulty, because of lack of strength, in using conventional release means (i.e. movement of levers or gripping an arm portion of a recliner chair) to initiate the extending action of a leg rest assembly and/or tilting action of the seat assembly.

An example of one type of leg rest release arrangement commonly utilized in the furniture industry includes an actuator button that is typically connected to a linkage assembly. Actuation of the button acts to move the linkage assembly for causing the leg rest assembly to protract and/or move the seat assembly to a tilted position. While several actuator button release systems currently exist, there remains a need for continued development of alternative release systems that are relatively simple in design and construction, are durable and yet are quiet and easy to operate.

Traditionally, recliners have a leg rest frame board that are moveable between the "stored" retracted position and a fully "extended" position. Typically, the elevation of the leg rest frame board, when fully extended, is not adjustable. Furthermore, when the leg rest board is biasingly urged via spring-assist mechanisms toward its fully extended position, there generally is no means for decreasing the amount of biasing force that must be exerted by the seat occupant to overcome the spring-assist mechanism in order to initiate the return of the leg rest board to its retracted or "stowed" position.

SUMMARY OF THE INVENTION

In accordance with the principles of the present invention, an improved reclining type article of furniture is disclosed which is designed to overcome various disadvantages associated with prior art recliners.

Accordingly, it is a basic purpose of the present invention to provide a recliner mechanism which permits the chair, sofa or loveseat to be placed directly against an adjacent wall surface without the necessity of providing a space therebetween. As such, the present invention is a "zero wall proximity" recliner mechanism which is fully reclinable within the confines of its stationary frame assembly.

It is an additional object of the present invention to provide a compact three-way recliner which permits use of loose cushions therewith. The "three-way" recliner provides operative linkages for "tilting" the seat unit, "reclining" the seat back relative to the seat frame and for extending and retracting the leg rest assembly.

It is another object of the present invention to reduce the input force exerted by the operator for smoother operation of the reclining mechanism. As a related object, the improved recliner mechanism has incorporated various linkage and drive components designed for substantially reducing frictional losses in an effort to promote easier actuation. Furthermore, the retracting movement of the leg rest assembly is utilized to assist in completely returning the seat unit to the "upright" position.

It is also a purpose of this invention to provide a reclining seat unit wherein the weight of the person occupying the seat unit is utilized as means to assist in moving a seat assembly from the "upright" position to the "tilted" and/or "reclined" positions and, while concurrently acting to assist in moving the leg rest assembly from a stored position to an elevated and operative position.

Another purpose of the invention is to provide a short-stroke drive assembly having an actuator lever, concealed in the upholstery, which may be easily operated by the seat occupant to concurrently operate the leg rest assembly and generate "tilting" movement of the seat assembly. In a preferred embodiment of the present invention, a sofa or loveseat has a leg rest assembly which is operated by the seat occupant rotating the actuator lever through a limited angle which, in turn, rotates a drive rod assembly for actuating the leg rest linkage. An over-center toggle mechanism is provided to assist in extending and retracting the leg rest assembly and in retaining the leg rest assembly in its "stowed" position. In addition, the drive rod assembly concurrently operates a drive linkage mechanism for "tilting" the seat unit relative to a stationary base assembly. Moreover, the included angle between the seat back and seat frame of the seat assembly remains substantially constant throughout the "tilting" movement. Following the "tilting" movement, the seat assembly can be additionally "reclined" by applying pressure to the seat back for increasing the included angle between the seat back and the seat frame. Therefore, "tilting" and "reclining" of the seat unit are independent of each other and are generally cumulative to define a "fully" reclined position.

In accordance with the present invention, forward movement of the seat unit relative to the base assembly is required prior to "reclining" movement of the seat back to compensate for rearward movement of the seat back so as to maintain a substantially constant clearance between the seat back of the seat unit and the adjacent wall surface. Furthermore, the "reclining" movement is easily initiated by the seat occupant by simply leaning his body to apply or remove pressure from the seat back. Due to the reduced frictional drag of the improved recliner mechanism, it is not necessary for the seat occupant to apply additional leverage with his arms or feet following sufficient rotation of the concealed actuator lever to continue the desired movement. In addition, "tilting" of the sofa or loveseat in conjunction with concurrent actuation of the leg rest assembly contributes significantly to the ease and smoothness of operation and also provides an added increment of comfort and consumer satisfaction.

It is yet another purpose of the present invention to provide a recliner mechanism incorporating a push-button assist mechanism operable to assist the seat occupant in initiating the extension of the leg rest assembly and tilting of the seat assembly.

A further object of the present invention is to provide means by which the relative ease of moving the leg rest assembly between its retracted and extended positions, as well as the angle of inclination of the leg rest frame board may be independently and selectively adjusted. Thus, seat occupants of various sizes and having differing amounts of strength would be able to adjust not only the angle or "cant" of the leg rest frame board, but also the amount of spring-biased "assist" that is provided during extension and retracting movements.

The present invention is further directed to a recliner type seat unit having assist means by which the initial movement of the leg rest assembly toward the retracted position may be easily initiated without significant effort by the seat occupant. In a preferred embodiment of the invention, the assist means is a push-button recliner assist mechanism which is operable to initiate and assist in extending the leg rest assembly and/or forward movement of the seat assembly to its tilted position upon the seat occupant merely depressing a push-button switch. Accordingly, only minimal effort by the seat occupant is required to initiate these movements.

The recliner mechanism of the present invention incorporates first adjustment means for adjustably limiting the outward travel of the leg rest assembly. When used in cooperation with other components of the recliner mechanism, the first adjustment means enables the angle of inclination of the extended leg rest member to be adjustably moved. Second adjustment means are provided for selectively varying the "assist" provided for extending and retracting the leg rest assembly. The first and second adjustment means are co-active to permit the seat occupant to smoothly initiate retraction of the leg rest assembly with decreased amounts of effort. This feature is particularly advantageous for individuals of limited strength who otherwise might have some degree of difficulty in initiating retraction of the leg rest member.

DESCRIPTION OF THE DRAWINGS

Additional objects, advantages, and features of the present invention will become apparent to those skilled in the art from careful consideration of the following written description and appended claims, taken in conjunction with the accompanying drawings wherein:

DETAILED DESCRIPTION OF THE INVENTION

In accordance with the teachings of the present invention, an improved reclining mechanism for use in single person (i.e., chairs) and multi-person (i.e., sofas and loveseats) articles of furniture is disclosed. As will be described in greater detail, the improved recliner mechanism is a "wall hugger" type or a "zero wall proximity" recliner unit. More particularly, the improved recliner mechanism is designed to travel within the confines of its stationary frame assembly for substantially flush mounting against an adjacent wall surface while permitting full reclining operation.

The recliner mechanism of the present invention is a "three-way" mechanism which can be independently "tilted", "reclined", and have its leg rest assembly operably retracted or extended. When a person sits in a loveseat or sofa equipped with the improved recliner mechanism, the leg rest assembly is extended by selectively rotating an actuator lever which is concealed in the sofa between an outer edge of the seat cushion and the inside arm. In addition, substantially concurrent "tilting" movement of the seat unit is provided upon such rotation of the actuator lever. Thereafter, independent "reclining" movement of the seat back relative to the seat is possible when the seat unit is in the "tilted" position. The recliner mechanism of the present invention is relatively compact in size to permit use of loose upholstered cushions which are modernly essential for marketing all styles of sofa or loveseat furniture.

Figure 1A:
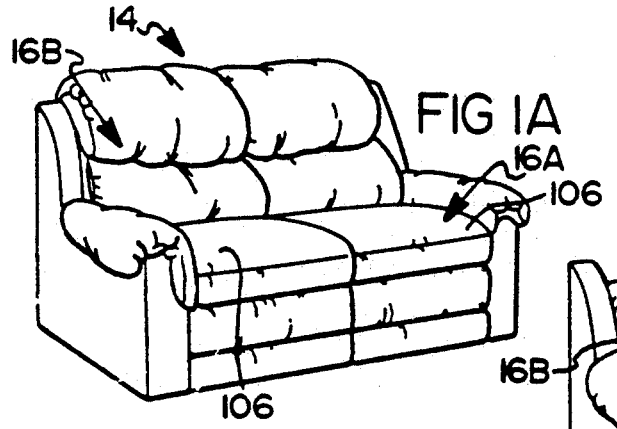
FIGS. 1A through 1C are perspective views of an exemplary upholstered "loveseat" having right and left reclining seat units embodying the present invention and which are shown in various upright and reclined positions.
Figure 1B:
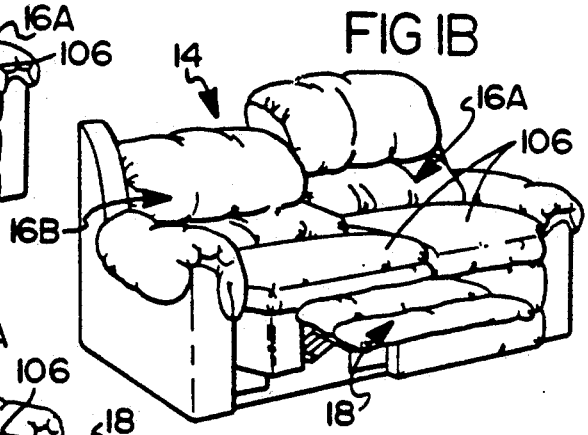
Figure 1C:
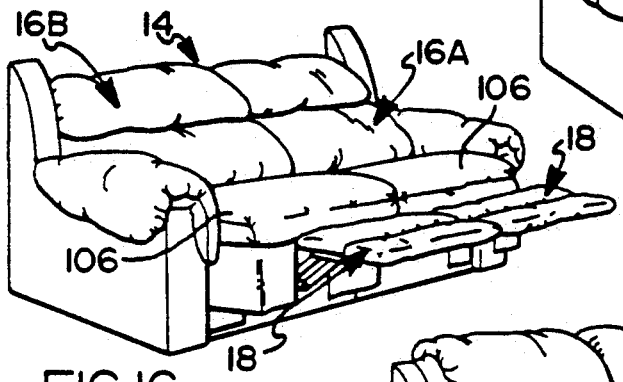
Figure 2A:
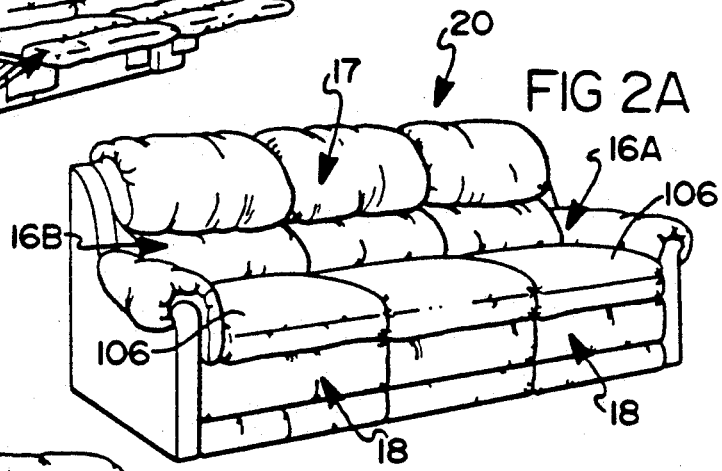
FIGS. 2A through 2C are perspective views of an exemplary upholstered "sofa" having left and right recliner seat units embodying the present invention and which are shown in various upright and reclined positions.
Figure 2B:
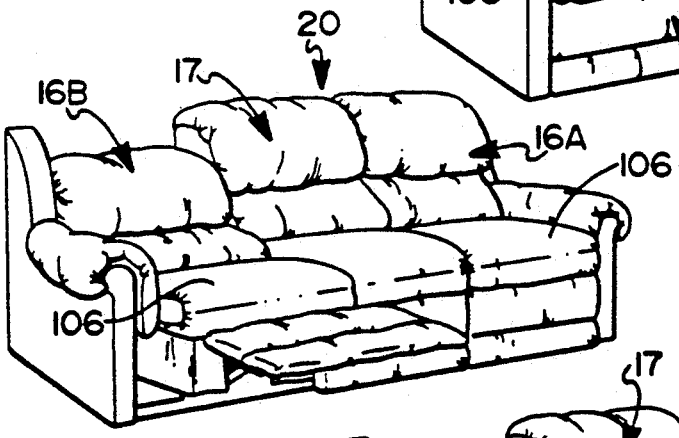
Figure 2C:
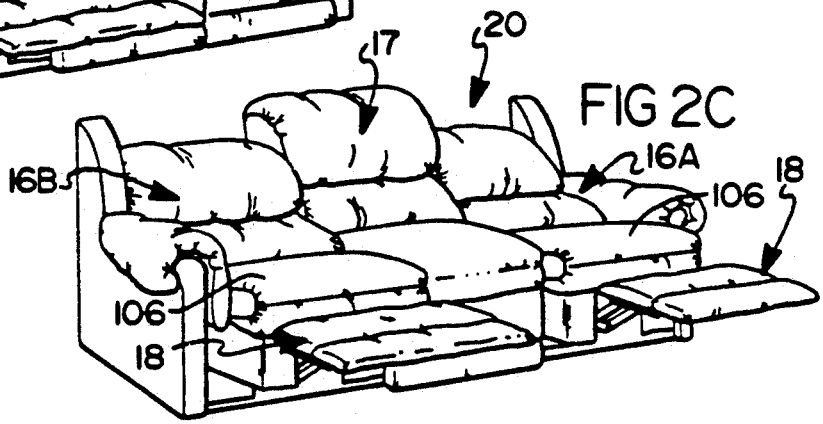

With particular references to the drawings, the operative relationship of an improved recliner mechanism 10 of the type adapted to be supported within a frame assembly 12 will now be described in greater detail. More particularly, FIG. 1A shows an exemplary loveseat 14 having right and left upholstered and reclinable seat units 16*a* and 16*b*, respectively, both of which are in their "upright" position. FIG. 1B illustrates left seat unit 16*b* reclined with its associated leg rest assembly 18 being protracted to an elevated position. FIG. 1C depicts reclined operation of both seat units 16*a* and 16*b* and their respective leg rest assemblies 18. Similarly, an exemplary sofa 20 is shown in FIGS. 2A through 2C having right and left upholstered and reclinable seat units 16*a* and 16*b*, respectively, in various combinations of upright and reclined positions.

Figure 4:
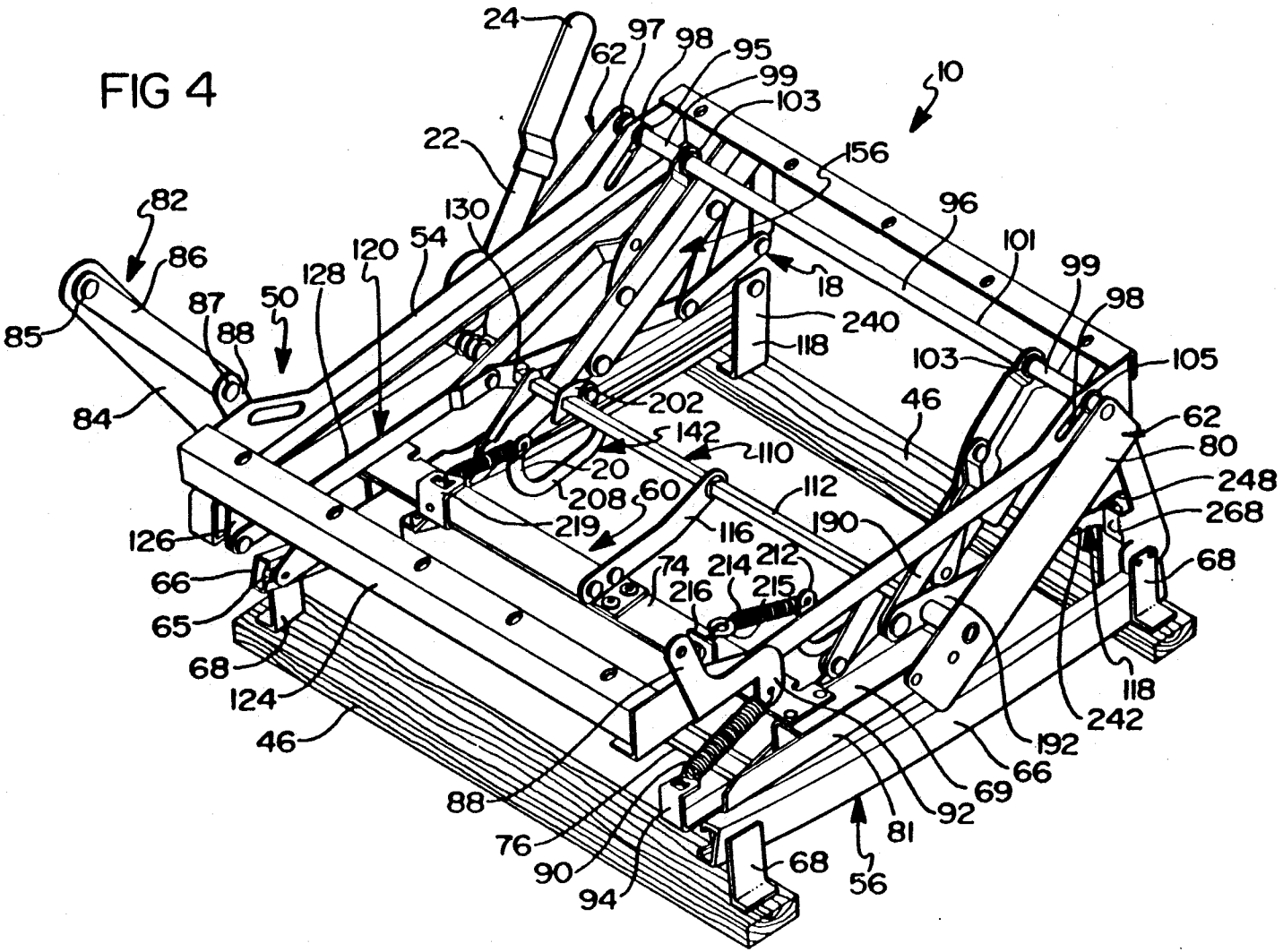
FIG. 4 is a perspective view with upholstery, springs, and other various parts removed, and which is partially disassembled for clarity, of the improved recliner mechanism adapted to be installed within the frame assembly of FIG. 3.

FIG. 4 is a perspective view of a right side recliner mechanism 10, with upholstery, padding, springs, etc. removed, which is adapted for use with right seat units 16*a* of loveseat 14 and sofa 20. It will be appreciated that the recliner mechanism to be used for left seat units 16*b* is substantially a mirror-image of that shown in FIG. 4. Moreover, the recliner mechanisms associated with seat units 16*a* and 16*b* each have a concealed actuator lever 22 with a handle portion 24 provided adjacent an arm portion of the sofa or loveseat that can be easily reached by a person seated in the seating unit for convenient actuation of recliner mechanism 10. However, it will be appreciated that other suitable manually operable release mechanism known in the art, such as a push-button cable release or an exterior mounted actuator lever, can be readily incorporated into the improved recliner mechanism of the present invention. Likewise, it is to be understood that while the preferred embodiments reflect incorporation of improved recliner mechanism 10 in sofas and loveseats, recliner mechanism 10 is likewise readily adaptable for use in other articles of furniture such as chairs, modular components, and the like.

Figure 3:
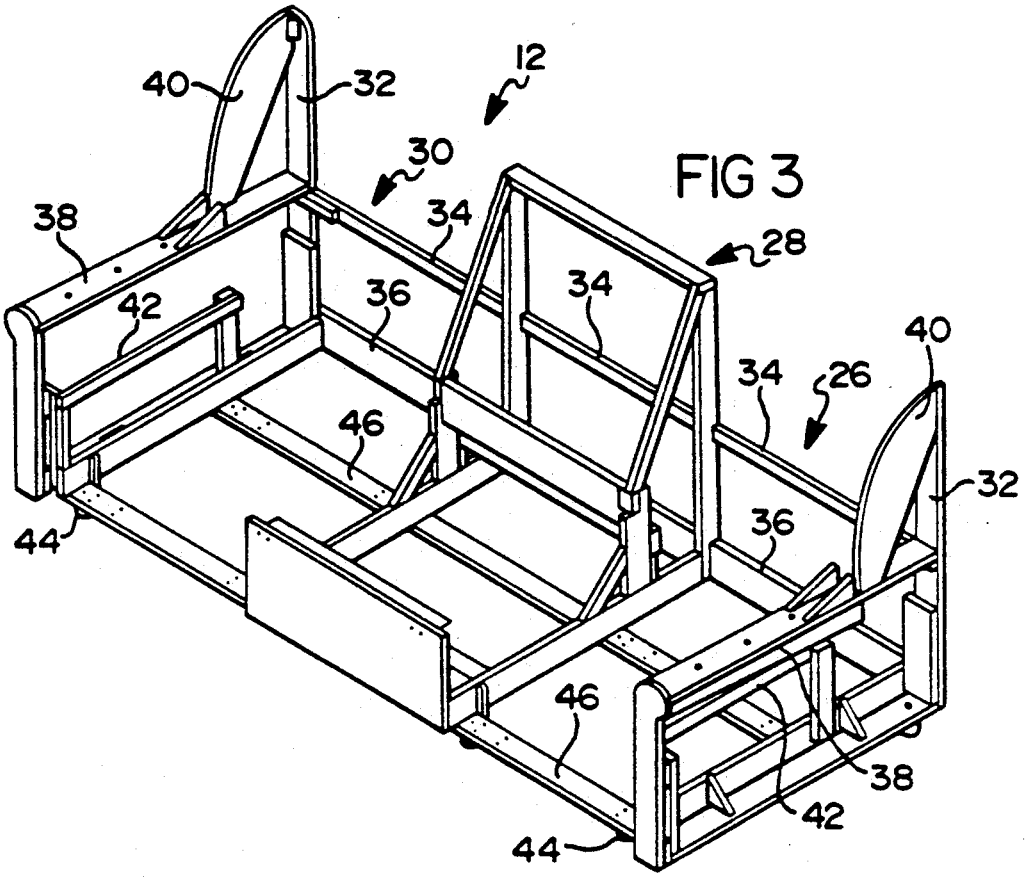
FIG. 3 is a perspective view of a frame assembly (with upholstery removed) for the sofa unit of FIGS. 2A through 2C and which is adapted to receive the improved reclining mechanism of the present invention therein.

With particular reference to FIG. 3, a stationary frame assembly 12 for sofa 20 is shown which is configured to support and retain left and right recliner mechanisms 10 therein. Frame assembly 12 defines three (3) frame sections 26, 28 and 30. Central frame section 28 is adapted to support a non-reclinable seat unit 17 thereon while outer sections 26 and 30 support seat units 16*a* and 16*b*, respectively. As will be appreciated, loveseat 14 would have a frame assembly that is substantially similar to frame assembly 12 except that center section 28 would be removed. Frame assembly 12 is preferably made of numerous wood rails that are fixedly secured together by suitable fasteners, such as dowels, staples, nails and screws, and which may be reinforced at critical joints by metal reinforcement plates or brackets and/or wood corner blocks in a known manner.

Frame assembly 12 has left and right vertical rear corner posts 32 and reinforcing rails 34 extending therebetween which are affixed to posts 32. Similarly, rear bottom rails 36 extend between and are affixed to a lower portion of posts 32. Frame sections 26 and 30 each include arm rails 38 which extend traversely to and are supported from posts 32. A diagonal brace piece 40 is used between arm rails 38 and an upper portion of vertical posts 32. Left and right lower inner side rails 42 define an inner edge for locating recliner mechanisms 10 thereon. A suitable leg assembly 44 may be affixed to the bottom of spaced bottom rails 46. Left and right recliner mechanisms constructed according to the present invention are adapted to be fixedly secured to a top surface of bottom rails 46 for full reclining operation within the confines of frame sections 26 and 30. Again, it is to be noted that the recliner mechanism mounted in left frame section 30 would be a left hand version (i.e., mirror-image) of the recliner mechanism 10 illustrated. While a specific frame assembly is described, it is to be understood that it is merely exemplary for purposes of illustration only.

With particular reference now to FIGS. 4 through 11, the various components of improved recliner mechanism 10 will be described in greater detail. In general, recliner mechanism 10 is provided to produce independent "tilting" and "reclining" movement of a seat assembly 50 within frame assembly 12 and selective operation of leg rest assemblies 18. Seat assembly 50 includes a seat back 52 and a seat frame 54 each of which is constructed in a manner that enables them to support springs, padding upholstery, etc. in order to complete a stylish and comfortable sofa or loveseat.

For purposes of clarity, the term "tilting" refers to angular movement of seat unit 16 and, in turn, seat assembly 50 relative to a stationary base assembly 56 mounted to bottom rails 46 of frame assembly 12. Recliner mechanism 10 is designed such that during "tilting" movement, a relatively constant included angle "A" between seat back 52 and seat frame 54 is maintained. Such "tilting" movement occurs substantially concurrently with protraction of leg rest assembly 18 via sufficient rotation of actuator lever 22 by the seat occupant. Likewise, return of seat unit 16 to the "upright" position occurs concurrently with return of leg rest assembly 18 to it "stowed" position. The term "reclining" refers to the relative angular movement of seat back 52 with respect to seat frame 54 for increasing the included angle to a maximum "B" therebetween. Generally, no significant "reclining" movement is possible when seating units 16 is in its normal "upright" position. However, following "tilted" movement of seat assembly 50 relative to base assembly 56, a predetermined range of additional "reclining" movement is possible for approaching a reclined position similar to a bed (i.e., a "fully" reclined position). Moreover, the present invention is designed to permit infinite adjustment of the desired reclined position within the range of reclining movement between the included angles "A" and "B".

Figure 7:
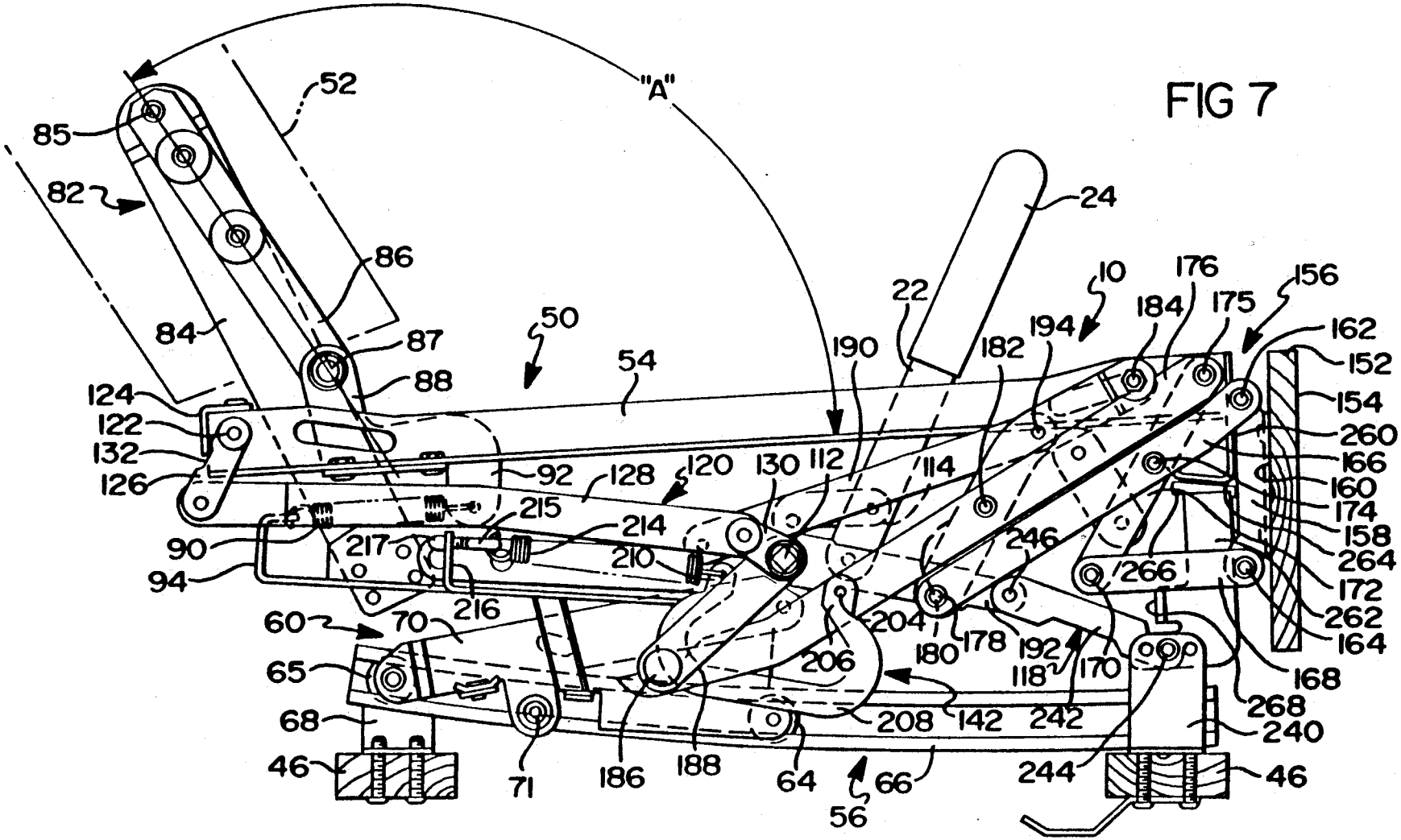
FIG. 7 is a view taken along line 7—7 of FIG. 6 illustrating the recliner mechanism in an "upright" position.
Figure 8:
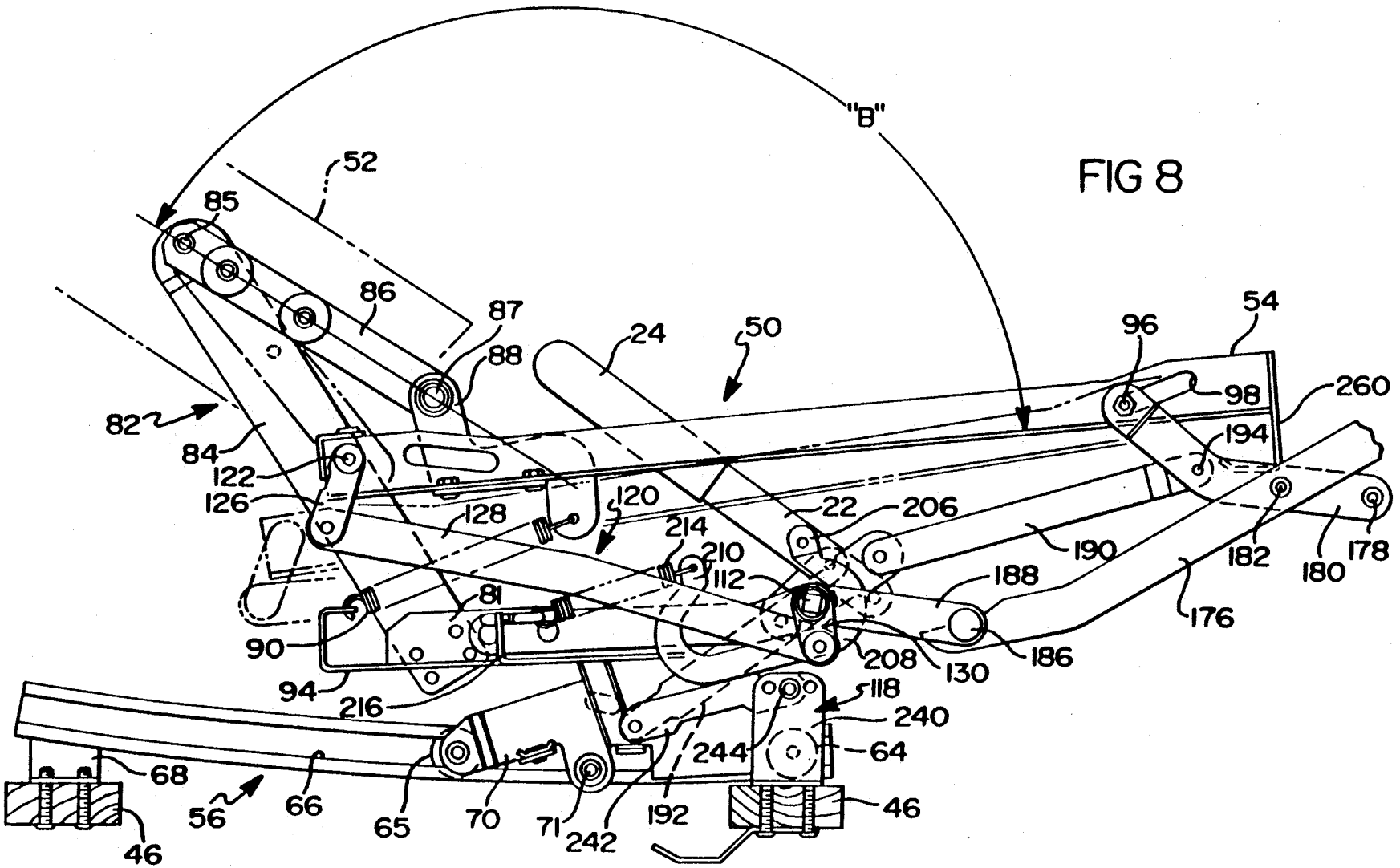
FIG. 8 is a view similar to FIG. 7 illustrating the leg rest assembly in an extended position and the seat assembly in a "tilted" (in phantom) and a fully "reclined" position.

FIG. 7 illustrates the operative relationship of seat assembly 50 and leg rest assembly 18 in their respective rear "upright" and "stowed" positions in which an occupant may enjoy conventional seating. FIG. 8 illustrates seat assembly 50 of recliner mechanism 10 in a forward fully "reclined" position and a "tilted" position (phantom lines). Likewise, leg rest assembly 18 is shown in its extended operative position. Upon rotation of actuator lever 22, seat assembly 50 is rearwardly "tilted" relative to a horizontal axis upon forward longitudinal movement on base assembly 56 to the position shown. In this "tilted" position, application of deliberate pressure by the occupant on seat back 52 permits the additional range of "reclining" movement. In this "fully" reclined position, the included angle "B" between seat back 52 and seat frame 54 is at its maximum level.

With particular reference to FIG. 4, the primary components of recliner mechanism 10 which produces the above-noted movement characteristics will now be described. Recliner mechanism 10 includes a wheeled carriage assembly 60 upon which mirror-image left and right side rail assemblies 62 are securely affixed for supporting seat assembly 50 therebetween. Carriage assembly 60 is supported for longitudinal fore and aft movement on stationary base assembly 56 for generating the "tilting" movement of seat assembly 50. More particularly, when carriage assembly 60 is released to move forward relative to base assembly 56, seat assembly 50 tilts to the "tilted" position. Likewise, rearward movement of carriage assembly 60 returns seat assembly 50 to the normal upright position.

Figure 9:
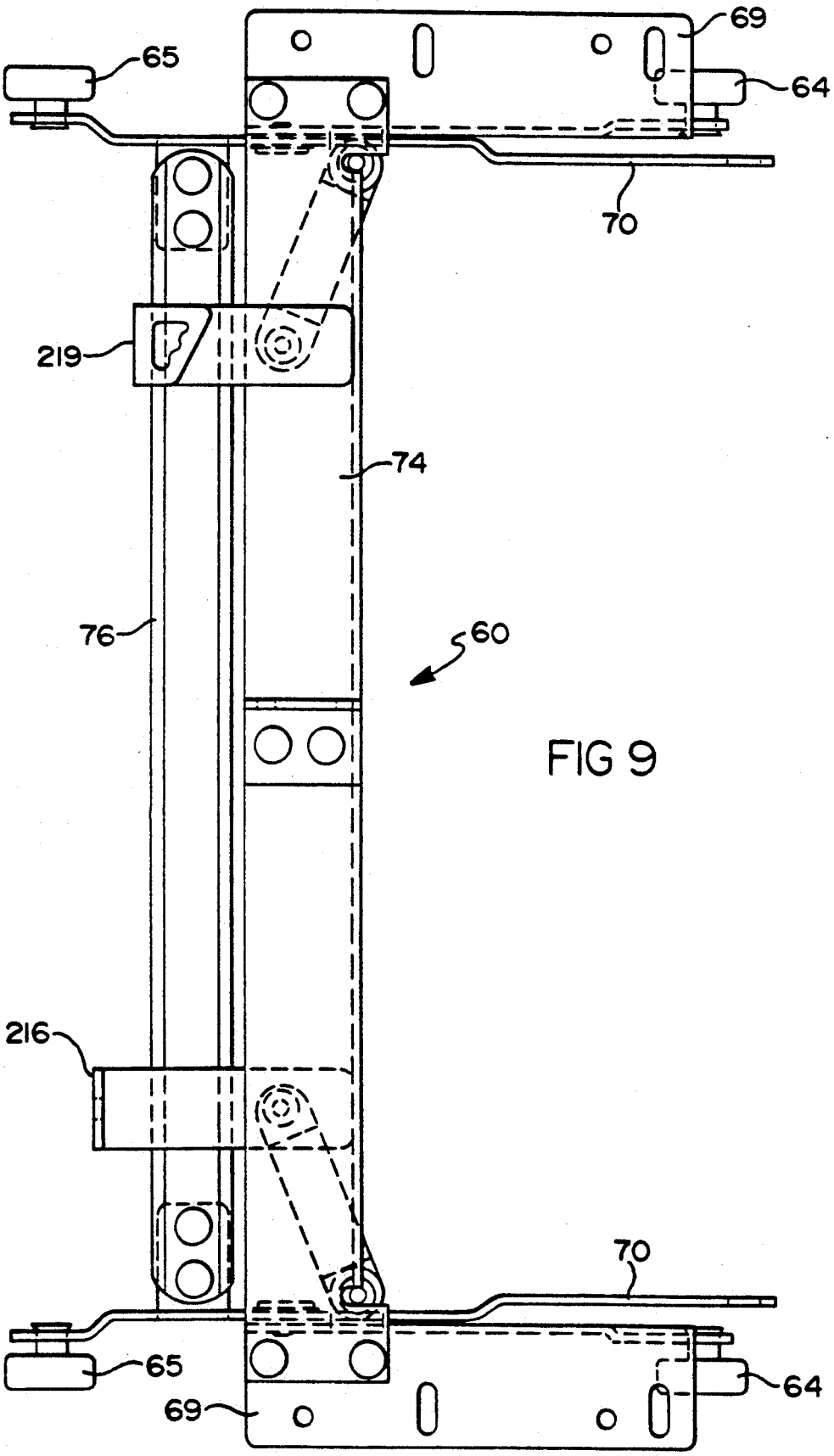
FIG. 9 is an enlarged plan view of the wheel carriage assembly of the present invention.
Figure 10:
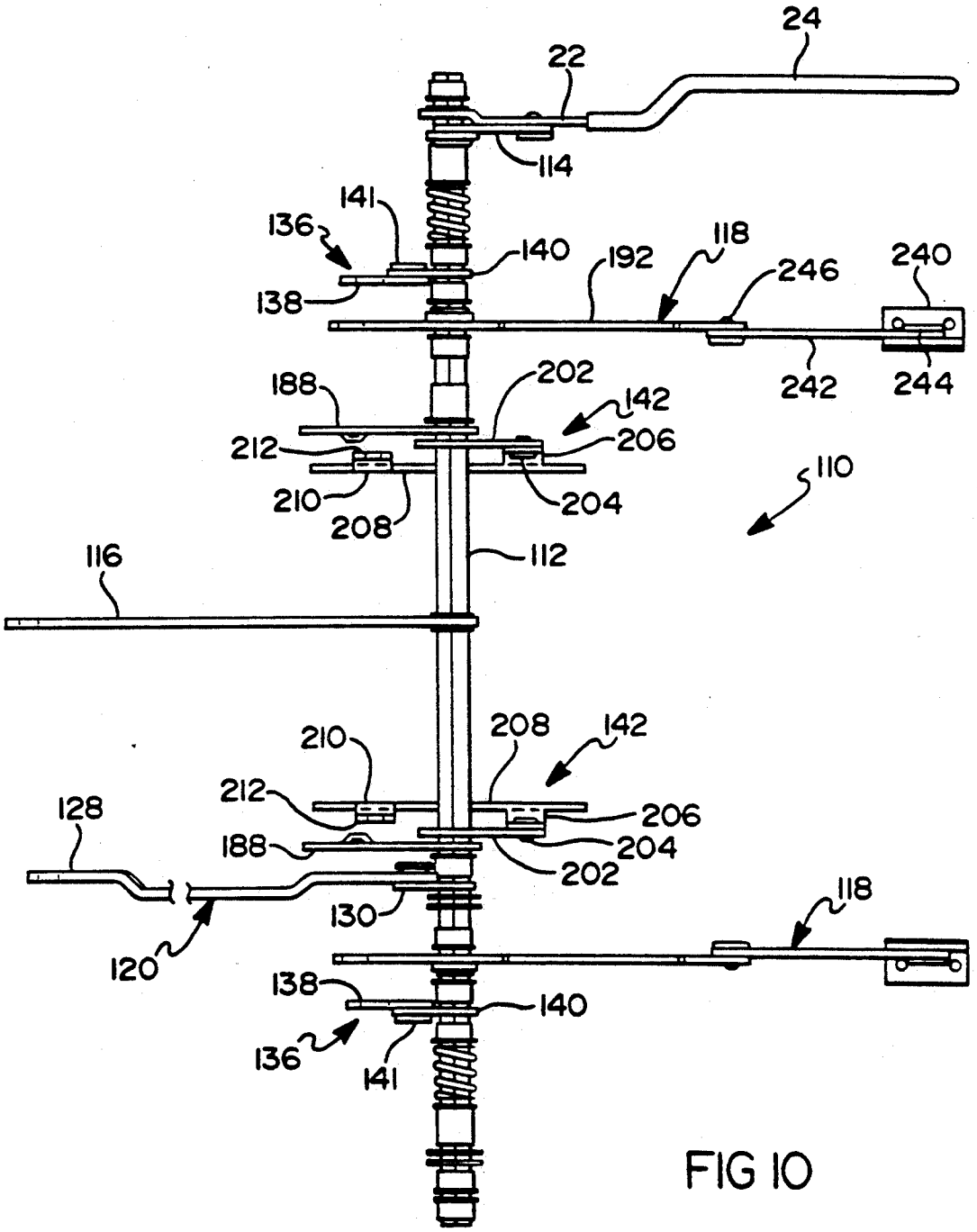
FIG. 10 is a plan view of the drive rod assembly incorporated within the improved recliner mechanism of the present invention.

Carriage assembly 60 is a rigid support structure having wheeled units 64 disposed for rolling movement in left and right tracks 66 of base assembly 56. Tracks 66 are aligned in parallel facing relation and are channel-shaped rectangular members which are preferably, downwardly curved from back to front to generate a gravity-assisted "down-hill" rolling movement of wheel units 64 therein. Tracks 66 are rigidly secured at opposite terminal ends via left and right angled brackets 68 to bottom rails 46 of frame assembly 12. With reference to FIG. 9, carriage assembly 60 is shown to include left and right angled brackets 69 each having a first wheel unit 64 secured to an outer forward portion thereof. Left and right pivot levers 70 are affixed to left and right angled brackets 69, respectively, for pivotable movement about pivot 71 and include a second wheel unit 65 at their rear-most end. The opposite end of pivot levers 70 is secured to its respective left and right "tilt linkages", the structure and operation of which will be described hereinafter. Extending transversely between left and right angled brackets 69 is an upper reinforcement rail 74. Similarly, transversely extending between left and right pivot levers 70 is a lower reinforcement rail 76. These reinforcement rails 74 and 76 provide structural rigidity to carriage assembly 60.

Left and right side rail assemblies 62 are affixed to carriage assembly 60 for supporting seat assembly 50 therebetween during "tilting" movement of seat assembly 50 upon forward movement of carriage assembly 60 on base assembly 56. In addition, side rail assemblies 62 pivotably interconnect seat back 52 and seat frame 54 for permitting independent "reclining" movement therebetween following "tilted" movement. Each side rail assembly 62 includes a seat plate 80 fixedly secured to a side plate bracket 81 which is, in turn, secured to its respective angled bracket 69 of carriage assembly 60. Left and right seat swing assemblies 82 are provided for pivotally coupling seat back 52 to seat frame 54 for "reclining" movement therebetween.

Seat swing assemblies 82 each include a generally rearwardly upstanding back member 84 having a lower end secured to a rearward end of its respective side plate bracket 81. The upper end of back members 84 are pivotally coupled at pivot 85 to a first end of swing members 86 upon which seat back 52 is mounted in a conventional manner. The opposite end of left and right swing members 86 are pivotally connected at pivots 87 to left and right seat brackets 88 which are, in turn, securely mounted to left and right frame rails of seat frame 54. Left and right extension springs 90 are attached between forward extensions 92 on seat brackets 88 which extend below seat frame 54 and rearwardly extending extension brackets 94 secured to angled carriage brackets 69. As such, seat assembly 50 is normally biased in a direction to maintain the normal included angle "A" between seat frame 54 and seat back 52 regardless of its "upright" or "tilted" relation to base assembly 56. Extension brackets 94 are provided with a plurality of stepped surfaces to which springs 90 can be selectively attached to permit adjustment of the spring biasing force acting on seat assembly 50.

A front support shaft 96 extends through lost-motion slots 98 formed in the left and right frame rails of seat frame 54 and is connected at its opposite ends to an upper end of left and right seat plates 80. The length of slots 98 define the range of forward movement of seat frame 54 relative to side rail assemblies 62 upon the seat occupant applying a force to "recline" seat back 52 (see FIGS. 7 and 8). In addition, friction means are provided for generating slight frictional drag upon movement of support shaft 96 within slots 98. In particular, nylon washers 95 coaxially supported on shaft 96 on opposite sides of slots 98, are biased to generate sufficient frictional drag to coact with extension springs 90 for permitting infinite reclining adjustment of seat assembly 50 between nonreclined included angle "A" and fully reclined included angle "B". Such interaction between springs 90 and the friction means also produces stable and smooth reclining movement which is not overly-sensitive to small amounts of movement by the seat occupant.

Figure 5:
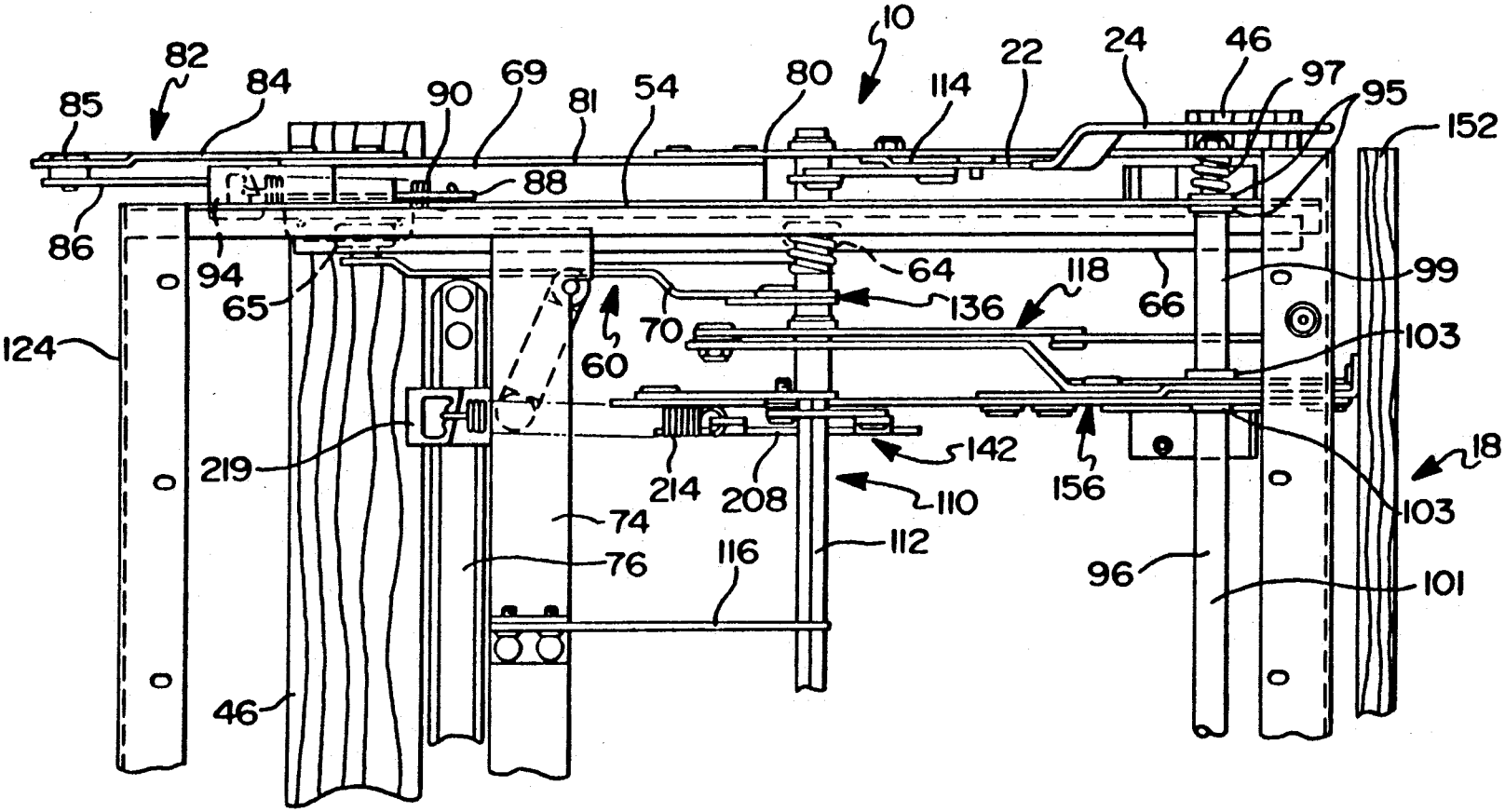
FIG. 5 is a plan view of the left half portion of the recliner mechanism of FIG. 4.
Figure 6:
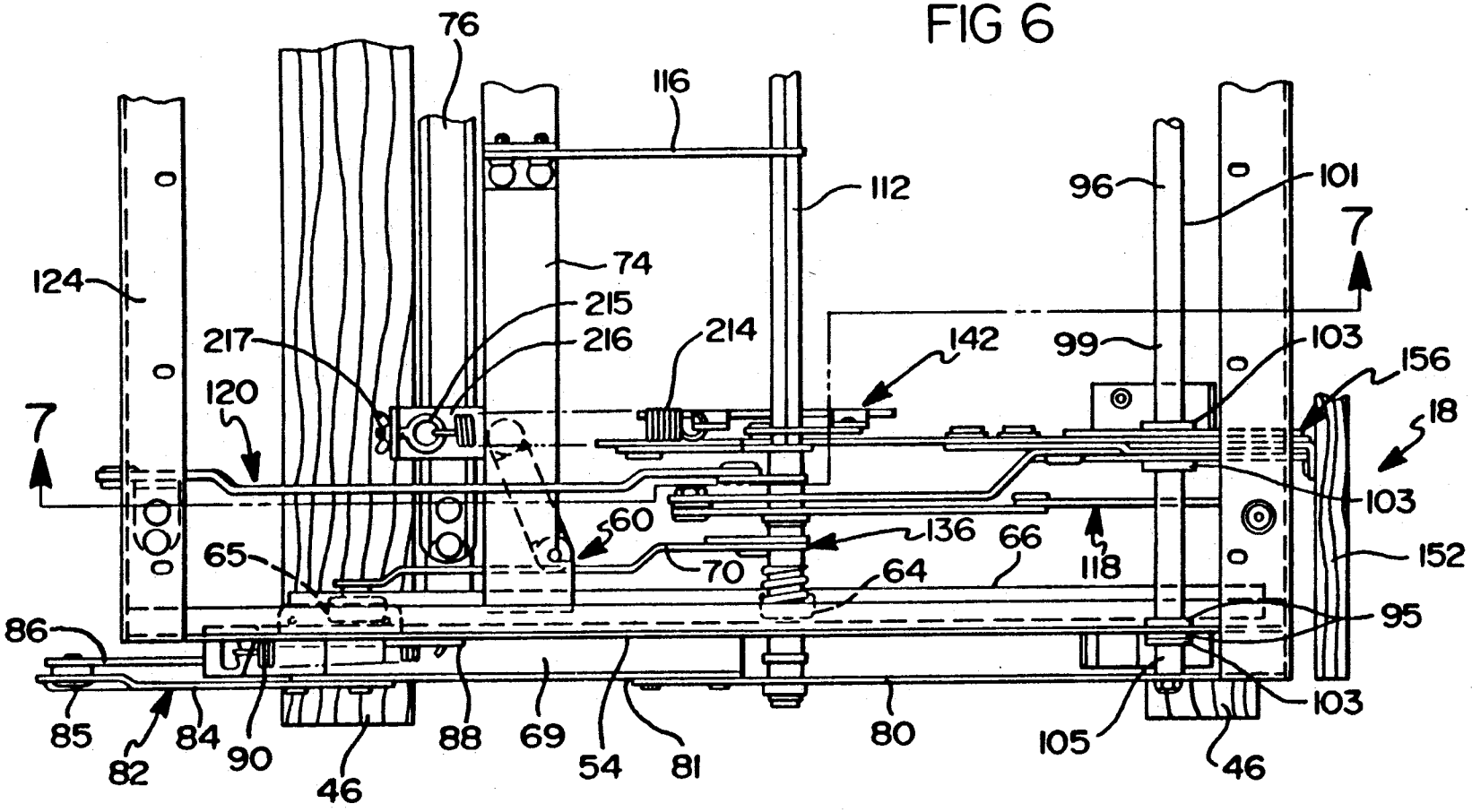
FIG. 6 is a plan view of the right half portion of the recliner mechanism of FIG. 4.

With reference to FIGS. 5 and 6, nylon washers 95 are shown biased by the interaction of several components. In particular, a spring 97 is provided which concentrically surrounds support shaft 96 between right seat plate 80 and a nylon washer 95 adjacent an outer surface of slot 98 (FIG. 4). Right and left short tubular spacer sleeves 99 and a longer central spacer sleeve 101 are coaxially supported on support shaft 96 and are provided for positively locating and separating portions of pantograph leg rest linkages 156. to be described hereinafter, thereon. Wave washers 103 provide a slight side-loading on spacer sleeves 99 and 101 and washers 95 to produce a rigid support shaft 96.

Swing assemblies 82, extension springs 90 and the friction means provided on support shaft 96 coact to substantially maintain the normal included angle "A" (FIG. 7 and FIG. 8 in phantom) between seat back 52 and seat frame 54 upon "tilting" of seat assembly 50 when carriage assembly 60 is released to roll downwardly and forwardly in tracks 66 of base assembly 56. However, to permit independent "reclining" movement for increasing the included angle to a maximum of "B", swing members 86 each pivot about both pivots 85 and 87 to cause substantially synchronous rearward pivotal movement of seat back 52 and forward movement of seat frame 54.

As is apparent, recliner mechanism 10 is confined below seat frame 54 with tracks 66 being affixed directly to wooden bottom rails 46 of frame assembly 12. In this manner, an overall reduction in the height of recliner 10 permits use of loose cushions 106 (FIGS. 1 and 2) removably installed on top of seat frame 54. In addition, recliner mechanism 10 is designed to cause less upward angular movement of seat frame 54 than conventional recliners upon forward motion thereof during "tilting" and "reclining" which significantly reduces the effort required for the seat occupant to return seat assembly 50 to the upright position and return leg rest assembly 18 to the stored position.

As previously noted, the preferred embodiment includes an actuation lever 22, which is hidden from view in the space between the outside edge of a cushion 106 and the upholstered inside face of sofa 20, and which must only be rearwardly pivoted a relatively small amount (approximately between 30°–45° in the preferred embodiment) by its forwardly extending handle 24 when the seat occupant wants to release carriage assembly 60 for "tilting" seat assembly 50 and raising leg rest assembly 18. More specifically, pulling back on handle lever 24 produces corresponding angular movement (counterclockwise in the drawings) of a square cross-section transverse drive rod assembly 110 which is rotatably supported by suitable means at its opposite ends to left and right seat plates 80 of left and right side rail assemblies 62. The axis of rotation of drive rod 112 is generally parallel to the axis of rotation of front and rear wheel units 64 and 65, respectively.

According to the preferred embodiment, carriage assembly 60, leg rest assembly 18, and drive rod assembly 110 are operatively interconnected so that when one moves, all move, (i.e. rotation of drive rod 112 is accompanied by movement of carriage assembly 60 on base assembly 56 and movement of leg rest assembly 18). Once the occupant has pivoted handle 24 through an angle of about 30°–45° which, in turn, correspondingly rotates drive rod 112, the weight of the seat occupant in cooperation with the force amplification and mechanical advantage of drive rod assembly 110 act to release (i.e. unlocks) carriage assembly 60 for forward movement on base assembly 56 for smoothly and continuously driving the various linkages until seat assembly 50 is in the forward "tilted" position with leg rest 18 extended.

Angular movement of drive rod 112 about its axis results in movement of various linkage mechanisms for causing actuation of leg rest assembly 18 and "tilting" movement of seat assembly 50 by releasing carriage assembly 60 to roll in tracks 66. As will be appreciated, the various linkages are designed to only require a limited range of angular movement of drive rod 112 via limited rotation of actuation lever 22 for putting recliner mechanism 10 into operation. In addition, the weight of the seat occupant and the center of gravity of seat assembly 60 defined by the orientation of wheel units 64 and 65 disposed within tracks 66 combine to generate a forwardly directed force on carriage assembly 60 which augments the limited occupant input required for improved operation of recliner 10. In addition, over-center toggle assemblies for leg rest assembly 18 and for carriage assembly 60 are designed to selectively lock and drive seat assembly 50 and leg rest assembly 18 between their respective "upright" and "stowed" positions and their "tilted" and "extended" positions.

Actuator lever 22 and its handle 24 are pivotally supported for angular movement to one of seat plates 80 and are located slightly forward of drive rod 112. A transfer linkage 114 connects actuator lever 22 to drive rod 112 for transferring the angular movement thereto. A stabilizer rail 116 is secured between a central portion of drive rod 112 and upper reinforcement rail 74 of carriage assembly 60. Stabilizer rail 116 permits rotation of drive rod 112 while providing structural rigidity with carriage assembly 60.

With particular reference now to FIGS. 7 and 8, means are provided for releasably locking drive assembly 110 for retaining carriage assembly 60 in its rear-upright position. More particularly, on opposite sides of stabilizer rails 116 there are provided left and right base bracket linkage assemblies 118 which are interconnected between bottom rails 46 of frame assembly 12 and pantograph linkages 156 of leg rest assembly 18 for acting as an over-center mechanism for releasably "locking" carriage assembly 60 in its rear-upright position as shown in FIG. 7. Bracket linkage assembly 118 includes a bracket 240 affixed to bottom rail 46 of frame assembly 12 and a base link 242 pivotally supported thereto about pivot 244. The opposite end of base link 242 is pivotably coupled to swing link 192 about pivot point 246. A rearward portion of swing link 192 is journally supported on drive rod 112 for free angular movement relative thereto. The opposite rear end of swing link 192 is pivotally interconnected to a first end of power link 190.

In the upright-stowed position of FIG. 7, a line of action extending through drive rod 112 and pivot 244 positions pivot point 246 in an over-center orientation for inhibiting forward non-actuated movement of carriage assembly 60 and leg rest assembly 18. Upon initial angular movement of handle 24 by the seat occupant, drive rod 112 rotates to initiate protraction of pantograph linkages 156 of leg rest assembly 18 outwardly toward their extended operative position. Such actuation of pantograph linkages 156 causes power link 190 to pivotably move swing link 192 until pivot point 246 is positioned below the line of action (i.e. over-center) to release carriage assembly 60 for forward rolling movement in tracks 66 and to release leg rest assembly 18 for movement to its fully extended position. A bent-over tab 248 formed on bracket 240 is provided to engage an edge surface of base link 242 to limit the over-center location of pivot point 246 relative to the line of action as shown in FIG. 7.

A locking mechanism 120 is provided which inhibits "reclining" movement of seat assembly 50 in the "upright" position and which coacts with slots 98 for limiting the range of "reclining" movement of seat assembly 50 once it is in the "tilted" position. More specifically, locking mechanism 120 includes a lock pivot 122 secured to rear frame rail 124 of seat frame 54, a lock lever 126 pivotally supported at one end to lock pivot 122, an elongated lock arm 128 pivotally connected to the opposite end of lock lever 126 and which extends generally parallel to side rail assemblies 62. The forward end of lock arm 128 is pivotally connected to a lock link 130 which is secured for angular movement with drive rod 112. A notch 132 in the rear edge of lock lever 126 is adapted to contact rear frame rail 124 for limiting the "reclining" movement of seat back 52 when recliner mechanism 10 is in its "tilted" positions.

Figure 11A:
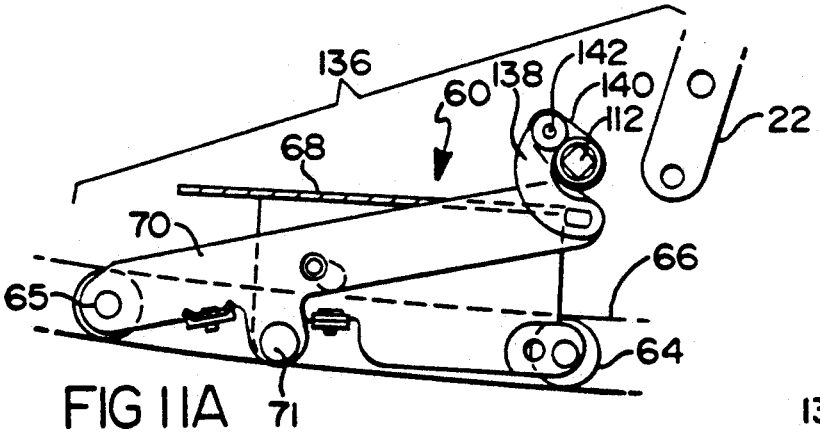
FIGS. 11A and 11B are side views of the tilt linkage mechanism incorporated within the improved recliner mechanism of the present invention shown in "locked" and "released" positions, respectively.
Figure 11B:
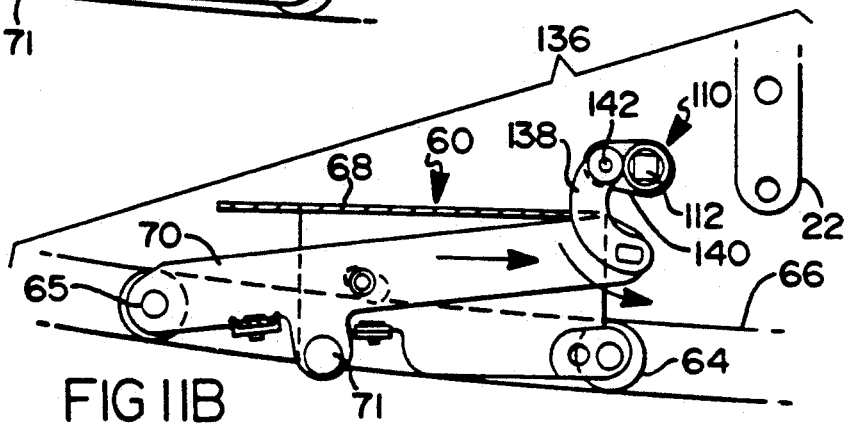

With particular reference to FIGS. 11A and 11B, drive rod assembly 110 is shown to include left and right "tilt" linkages 136 which are generally coactive with bracket linkage assemblies 118 for selectively inhibiting (i.e. locking) and permitting (i.e. releasing) forward movement of carriage assembly 60 on base assembly 56. In general, tilt linkages 136 interconnect the forward end of pivot levers 70 of carriage assembly 60 to drive rod assembly 110. More particularly, the forwardmost end of pivot levers 70 extend below and are generally aligned with the axis of drive rod 112 and are pivotally connected to a lower end of a C-shaped toggle link 138. The other end of C-shaped toggle link 138 is pivotably connected to a connector link 140 at pivot 141 and which, in turn, is secured on drive rod 112 for angular movement therewith.

When recliner mechanism 10 is in the upright position (FIG. 11A), tilt linkage assemblies 136 are inhibited against forward movement of carriage assembly 60 until actuator lever 22 and, in turn, drive rod 112 are sufficiently rotated (approximately 30°–45°) for causing bracket linkage assemblies 118 to move to the over-center position. Rotation of drive rod 112 causes corresponding rotation of connector link 140 until pivot 141 is aligned with or slightly below the rotational axis of drive rod 112 (FIG. 11B). At this point, bracket linkage assemblies 118 have gone over-center to release carriage assembly 60 such that loading acting on carriage assembly 60 (i.e. weight of occupant) and the mechanical advantage of tilt linkages 136 act to forwardly drive C-shaped toggle 138 around and below drive rod 112 so as to permit pivot levers 76 to pivot about pivot points 71 such that carriage assembly 60 is "tilted" upon forward rolling movement in tracks 66.

Tilt linkages 136 provide significant force amplification so that the force required for the occupant to pivot handle 24 is not excessive. It will be appreciated that left and right spring-assist toggle mechanisms 142 associated with operation of leg rest assembly 18 which will be hereinafter described, work coactively with bracket linkage assemblies 118 and tilt linkages 136 to smoothly and continuously drive recliner mechanism 10 for extending leg rest assembly 18 and for "tilting" seat assembly 50 in a substantially concurrent manner.

Leg rest linkage assembly 18, pantograph linkages 156, and left and right toggle mechanisms 142 are seen best in FIGS. 4, 7, and 8. These devices are similar to, but not identical with, corresponding mechanisms shown and described in the present assignee's U.S. Pat. No. 4,367,895, issued Jan. 11, 1983, entitled "Reclinable Chair" as well as its U.S. Pat. No. 3,099,487, issued Jul. 30, 1963, entitled "Leg Rest Fixture and Supplemental Holding Mechanism".

With particular reference to FIG. 7, leg rest assembly 18 is shown to include a frame board 152 having an upper surface 154 that is padded and upholstered so that in the finished sofa it will be as shown in FIGS. 1 and 2. Board 152 is supported on and moved by identical left and right hand pantograph linkages 156. Board 152 has an angled bracket 158 secured to its bottom face 160 for each pantograph 156 whereby board 152 is pivotally connected at a rear pivot 162 and a front pivot 164 to board links 166 and 168, respectively, of pantographs 156. The other end of front board link 168 is pivoted at 170 to an end of connector link 172 which is centrally pivoted at 174 to a portion of board link 166. The other end of connector link 172 is pivoted at 175 to the top of a long support link 176. The other end of rear board link 166 is pivoted at 178 to one end of a curved link 180 which is pivoted at a central pivot 182 to a central portion of long support link 176. The other end of curved link 180 is pivoted at 184 to front support shaft 96. Pivot 184 is a point of support on carriage assembly 60 for pantographs 156.

Another point of support is pivot 186 at the curved bottom end of long support link 176 which connects support link 176 to one end of drive link 188, the other end of which has a square aligned hole through which square drive rod 112 extends so that drive link 188 is generally driven by angular movement of drive rod 112. Thus, rotation of drive rod 112 turns drive link 188 which acts through pivot 186 to move long support link 176. Such movement of support link 176 causes link 180 to swing about fixed pivot 184 by virtue of pivot connection 182 that link 180 has with long support link 176. The action of link 180 swinging about fixed pivot 184 moves rear board link 166 outwardly and upwardly while pivot 175 at the top end of long support link 176 causes link 172 to swing about pivot 174 and thus front board link 168 is also moved outwardly and upwardly. This extensible action takes place simultaneously with both the left hand and right hand pantographic linkage mechanisms 156 when there is sufficient angular movement of drive rod 112 to unlock toggle mechanism 142. The effect is to move frame board 152 between its stowed vertical position (FIGS. 1B, 2B and 7) and its elevated, relatively horizontal position (FIGS. 1C, 2C and 8).

Left and right power links 190 are shown to extend over drive rod 112 and are pivotally supported at their rearward end on a portion of swing links 192 mounted on drive rod 112 and at their top ends at pivots 194 located on a central portion of curved links 180. Upon swinging movement of curved links 180 in the manner previously described, power links 190 act to assist in driving pantograph linkages 156 to their extended operative position. As mentioned, power link 192 interconnects pantograph linkages 156 to bracket linkage assemblies 118.

Left and right hand spring-assist toggle assemblies 142 are provided which, as pointed out in U.S. Pat. Nos. 3,099,487 and 4,367,895, work with leg rest assembly 18. Toggle assemblies 142 provide means for holding leg rest assembly 18 tightly in a fully retracted (i.e. stowed) position against the front of the sofa frame and also provides means for supplying a spring force for driving leg rest assembly 18 to its extended position. Toggle assemblies 142 each include a toggle lever 202 with a square hole which is mounted by means of the square hole on square drive rod 112 for selective rotation therewith. Toggle lever 202 is pivotally connected at 204 to front leg 206 of a C-shaped toggle link 208 that curves around, below and to the rear of drive rod 112 where its rear leg 210 has an opening 212 in which one end of a helical coil spring 214 is hooked. The opposite end of spring 214 is hooked to an eye screw 215 threadably secured to spring bracket 216 which, in turn, is secured to upper stabilizer rail 74.

As shown in FIG. 6, a wing nut 217 is provided for adjusting the tension in spring 214. For example, the tension in spring 214 can be adjustable relieved for a lighter weight occupant or it can be increased for a heavier seat occupant. Such adjustment means provide an extra comfort and convenient feature to recliner mechanism 10. The opposite spring 214 is shown in FIG. 5 to be secured to a second bracket 219 which has stepped surface means for step-wise spring biasing adjustment similar to bracket 94.

Operation of toggle assemblies 142 will now be described in greater detail. The location of pivot 204 below drive rod 112 and the line of action of springs 214 are such in the retracted position of leg rest assembly 18 that the spring force holds or "retains" leg rest assembly 18 retracted. As leg rest 18 is initially slightly extended upon rotation of actuator lever 22 and, in turn, drive rod 112, pivot 204 moves up and over center of the drive rod axis. Once pivot 204 is over center, tension loading on springs 214 assist in drivingly rotating drive rod 112 for elevating leg rest assembly 18 as rear leg 210 of link 208 is pulled toward reinforcement rail 74. In addition, springs 214 to assist the occupant in pivoting handle 24 through the require actuation angle. Once drive rod 112 has been sufficiently pivoted through the limited actuation angle to release carriage assembly 60 (via bracket linkage assemblies 118) and leg rest assembly 18 (via toggle mechanisms 142), the weight of the seat occupant and the biasing of springs 214 rotate handle 24 to the fully pivoted and concealed position shown in FIG. 8.

Downward pressure applied manually to frame board 152 by the seat occupant serves as means to move leg rest assembly 18 back to the "stowed" position and carriage assembly 60 rearwardly for tilting seat assembly 50 to the "upright" position. Such pressure has the benefit of a long moment arm and produces a downward rearward movement of long support links 176 which act through their pivots 186 to rotate drive links 188 in a rearward direction. This causes corresponding angular movement of drive rod 112 (i.e. clockwise in the drawings). When pivot 204 is rotated over center upon continued clockwise movement of drive rod 112, C-shaped toggle links 208 and springs 214 act as locking means to solidly hold leg rest assembly 18 in its stowed position. Likewise, this same clockwise rotation of drive rod 112 causes swing links 192 and base links 242 of bracket linkage assemblies 118 to be rotated overcenter for retaining carriage assembly 60 against forward movement which, in turn, assist in retaining seat unit 16 in its "upright" position. It will be appreciated that the various linkages are designed to work substantially simultaneously and in a cumulative manner.

The relatively low input force to be exerted on frame board 152 by the occupant permits smooth retraction of recliner mechanism 10 to the conventional seating arrangement position of FIGS. 4 and 7. Likewise, toggle mechanisms 142 and tilt linkages 136 are adapted to return to their original position (FIG. 7) for assisting in locking carriage assembly 60 and leg rest assembly 18 in their respective "upright" and "stowed" positions upon rearward movement of leg rest assembly 18 to a position in close proximity to the normal "stowed" position. As will be appreciated, this "locking" position is directly related to the amount of pivotable movement of actuator lever 22 required to actuate recliner mechanism 10.

Another feature of the present invention incorporated into recliner mechanism 10 provides rigidity and support to the forward end of seat assembly 50 when retained in the "upright" position and which controls forward movement of carriage assembly 60 for supporting leg rest assembly 18 in its fully extended position. In particular, seat frame brackets 260 are affixed to front corner surfaces of seat frame 54 and are adapted to matingly contact brackets 262 supported from brackets 240 when seat assembly 50 is in its rear-upright position and a load is applied thereto. In particular, frame brackets 260 have a surface, such as a nylon insert 264, which is adapted to engage a facing insert 266 supported on bracket 262. Therefore, weight transferred downwardly onto the front of seat frame 54 is supported to inhibit "sagging" of seat assembly 50. Brackets 262 are also formed to include a vertical stop surface 268 adapted to engage a forward edge surface of brackets 69 of carriage assembly 60 when carriage assembly 60 is in its forwardmost position relative to tracks 66. This engagement provides additional support to leg rest assembly 18 through its linkages to inhibit "sagging" thereof in the extended operative position.

Thus, the invention provides a sofa construction that has a seat frame 54 and seat back 52 that move between an "upright" position (FIG. 7), a "tilted" position (FIG. 8 in phantom) and a "reclined" position (FIG. 8). Manual force, leveraged through leg rest pantographic linkages 156, is used to overcome gravity and the spring force provided within recliner mechanism 10 for smoothly and easily returning seat assembly 50 from the "tilted" to the "upright" position and leg rest assembly 18 from its extended to its stowed position.

Figure 12:
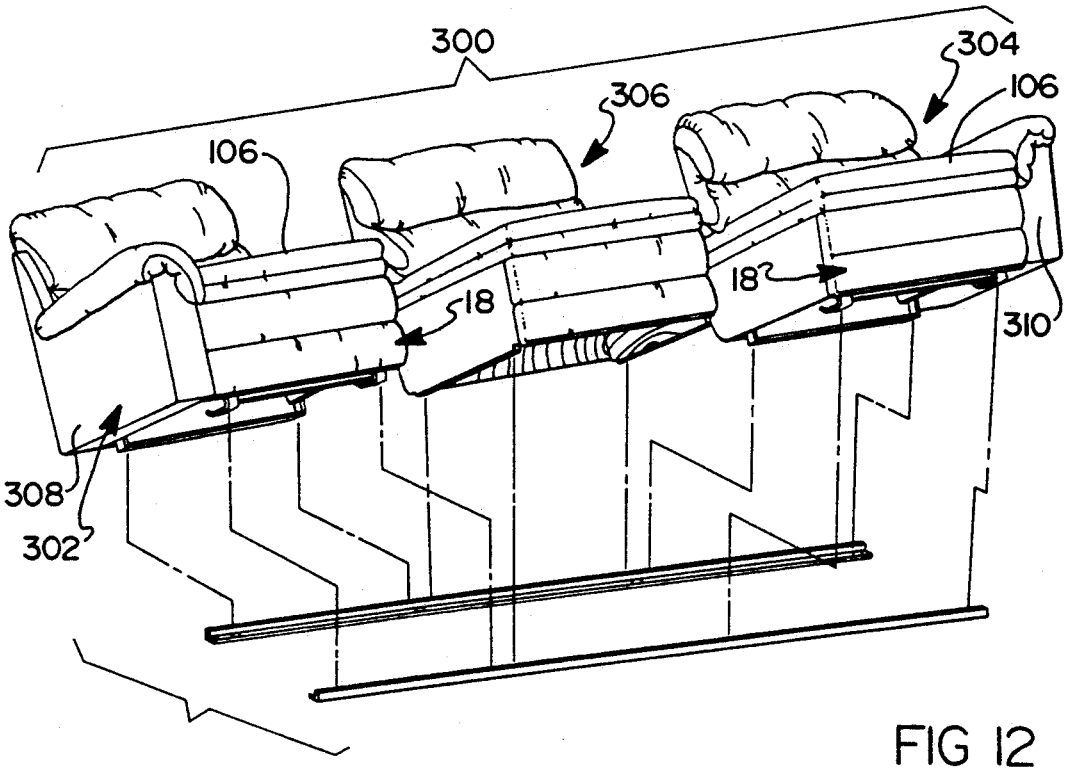
FIG. 12 is an exploded illustration of the independent seating units of a modular sofa, where the two outermost end units incorporate recliner mechanisms.

Referring now to FIG. 12, there is shown a modular sofa 300 having independent reclinable seat units 302 and 304, and a fixed (i.e. non-reclinable) seat units 306. Reclinable seat units 302 and 304 are of substantially identical construction, with the principal exception being the inclusion of arm portions 308 and 310 on opposite sides thereof. Accordingly, for the purposes of discussion, only reclinable seat unit 302 will be discussed. However, it will be appreciated that the construction and operation of reclinable seat unit 304 will be substantially similar to seat unit 302 with a noted exception of the positioning of the arm rest portion 310 of seat unit 304.

Figure 13:
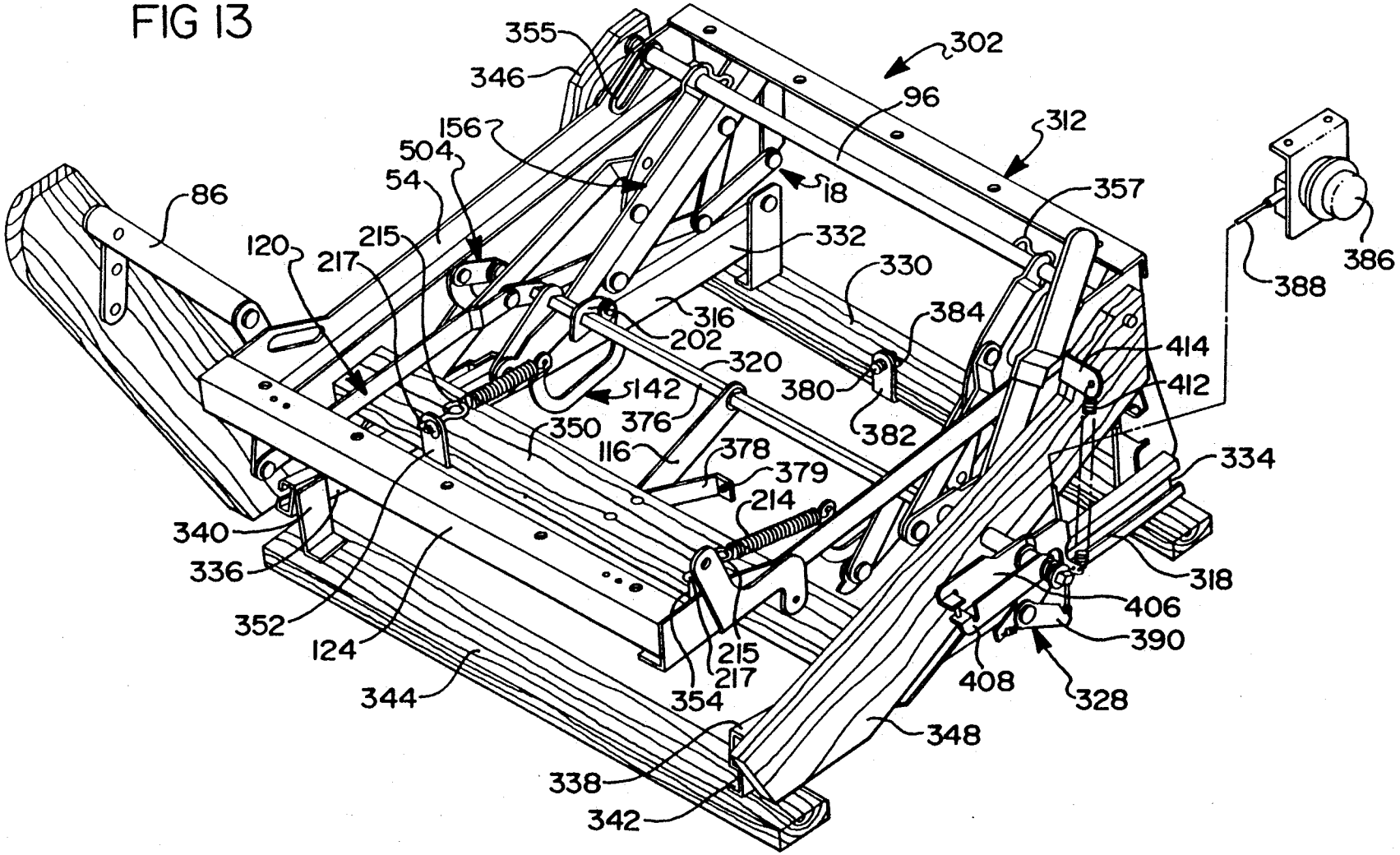
FIG. 13 is a perspective view with upholstery, springs and other various parts removed, and which is partially disassembled for clarity, of a second preferred embodiment of the recliner mechanism of the present invention, adapted to be installed as part of one of the independent seat units of the modular sofa of FIG. 12.

With particular reference to FIG. 13, a recliner mechanism 312 is shown that is constructed in accordance with an alternative preferred embodiment of the present invention and which is adapted for use in seat unit 302. As will be appreciated, recliner mechanism 312 is a modified version of recliner mechanism 10. More particularly, recliner mechanism 312 is a "three-way" mechanism which can be independently "tilted", "reclined" and have its leg rest assembly 18 operably retracted or extended in a manner substantially similar to that previously described. It is to be understood that while recliner mechanism 312 is shown in association with sofa 300, it is likewise readily adaptable for use in other articles of furniture such chairs, modular components, and the like.

As best seen from FIG. 13, recliner mechanism 312 generally includes a seat assembly 314, a pair of laterally spaced and outwardly opening tracks 316 and 318, a drive rod assembly 320 and leg rest assembly 18. These components are substantially identical to corresponding components incorporated into recliner mechanism 10. As such, like numbers are used hereinafter to designate those components previously described. Accordingly, recliner mechanism 312 also includes various other linkages, mechanisms and components that are also substantially identical to those previously shown and described with respect to recliner mechanism 10. Examples of such mechanisms and components include, but are not limited to, locking mechanism 120, tilt linkage assemblies 136, spring-assist toggle mechanisms 142, bracket linkage assemblies 118 and pantograph linkage assemblies 156. To the extent that these previously described mechanisms and components are not substantially different in form and operation in recliner mechanism 312, they will not be discussed in detail.

It should also be appreciated that the recliner mechanism 312 incorporates various structures and features that are similar to corresponding structures and features shown and described in other copending applications of the present assignee, the disclosures of which are each incorporated herein by reference. For instance, the manually operated actuator lever and its release linkage are substantially the same as that shown and described in copending application Ser. No. 715,851, filed Jun. 20, 1991, entitled "Chair Mechanism". Further the method and apparatus for alignably mounting independent reclinable seat units together via a pair of parallel, spaced apart frame rails to form a modular sofa (i.e. as depicted in FIG. 12) is substantially similar to that shown and described in copending application Ser. No. 685,581, filed Apr. 17, 1991, entitled "Mounting Apparatus For Modular Sofa Assembly". The common details and function of these various components described in the co-pending applications set forth above, while made part of the present invention herein relating to recliner mechanism 312, will not be repeated.

Figure 14:
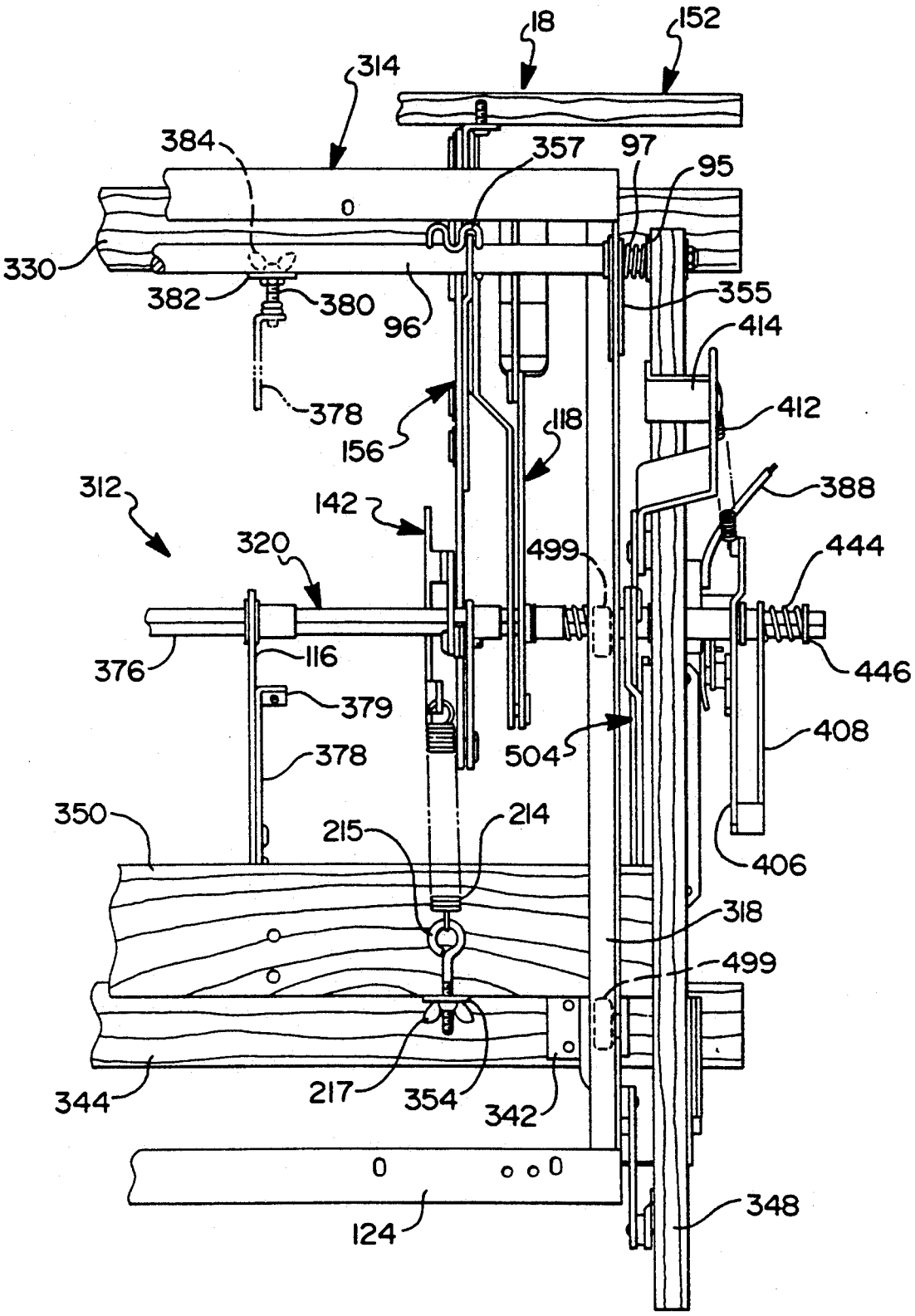
FIG. 14 is a fragmentary plan view of the right half-portion of the recliner mechanism shown in FIG. 13.

With continued reference to FIGS. 13 and 14, recliner mechanism 312 is shown to also include a front bottom frame rail 330 to which front end portions 332 and 334 of tracks 316 and 318, respectively, are secured. Tracks 316 and 318 also include rear end portions 336 and 338, respectively, which are secured via brackets 340 and 342 to a rear bottom frame rail 344. Moreover, a pair of laterally spaced wooden side frame members 346 and 348 are secured between front and rear bottom frame rails 330 and 344, respectively. An upper stabilizer rail 350 is fixedly secured in between the side frame members 346 and 348 and includes first and second spring brackets 352 and 354, respectively. In addition, spring 97 concentrically surrounds one end of support shaft 96 between wooden side rail 348 and nylon washer 95 adjacent an outer surface of slot 98. A nylon insert 355 is retained within slot 98 for minimizing frictional resistance to movement of the front end of seat assembly 314 with respect to support shaft 96. In addition, generally sinusoidal spring clips 357 are provided for positively locating and separating portions of pantograph leg rest linkages 156 on support shaft 96 while inhibiting rotation of support shaft 96.

Secured to each of spring brackets 352 and 354, via adjustable wing nuts 217, are eye screws 215. In association with left and right toggle linkage assemblies 142, means are provided for selectively adjusting the degree or amount of biased "assist"generated. More specifically, coupled to each eyelet portions of eye screws 215 is a first end of helical coil springs 214 which is coupled at its opposite end to a rear leg portion 210 of C-shaped toggle links 208. Toggle link 208 is pivotally secured to a toggle lever 202 which, in turn, is fixedly secured for rotation with square drive rod 376 of drive rod assembly 320. As will be described hereinafter, the tensioning on coil springs 214 can be selectively adjusted for varying the rate or "speed" at which the leg rest pantograph linkages 156 move between their "stowed" and "elevated" positions. Such rate adjustment directly corresponds to the degree of spring-biased "assist" provided by the toggle linkage assemblies 142.

In accordance with a novel feature of the present invention, releasable assist means are provided in association with recliner mechanism 312 for permitting the seat occupant to initiate movement of the leg rest assembly toward its extended position. The releasable assist means permits the seat occupant to deliberately initiate movement of the leg rest assembly toward its extended and elevated position with virtually no physical effort. Such an arrangement is particularly advantages for elderly or handicapped persons or others having difficulty in using conventional release mechanism (i.e. levers and the like). More specifically, recliner assist mechanism 328 is shown to include a push-button release switch 386 coupled via a cable 388 to an actuator bracket 390. Actuator bracket 390 is pivotally coupled to an "over-center" type cocking linkage assembly 392 having first and second pivotally coupled link members 394 and 396, respectively. Actuator bracket 390 is also pivotably coupled about pivot point 391 to a base bracket 398 which is, in turn, fixedly secured to an outer sheath portion 400 of cable 388 via a threaded screw 402 and retaining member 404.

Recliner assist mechanism 328 also includes a drive assist bracket 406 and a drive bracket 408. Drive assist bracket has a first end 410 which is coupled to a first end of first coil spring 412. First coil spring 412 is coupled at its opposite end to a spring bracket 414 with spring bracket 414 being fixedly secured to an upper and forward portion of wooden side frame member 348. A second end portion 416 of drive assist bracket 406 includes a transversely extending shoulder portion 418 having a button-type grommet 420 secured in an aperture 422 formed therein. Drive assist bracket 406 is pivotally coupled about an upper pivot point 423 to first link member 394 via a rivet 424 which extends through a washer 426 and an aperture 428 in drive assist bracket 406 and an aperture 430 in first link member 394. Furthermore, drive assist bracket 406 is journalled for rotational movement via bushings 432 and 434, and aperture 436, about drive rod 376.

Figure 15:
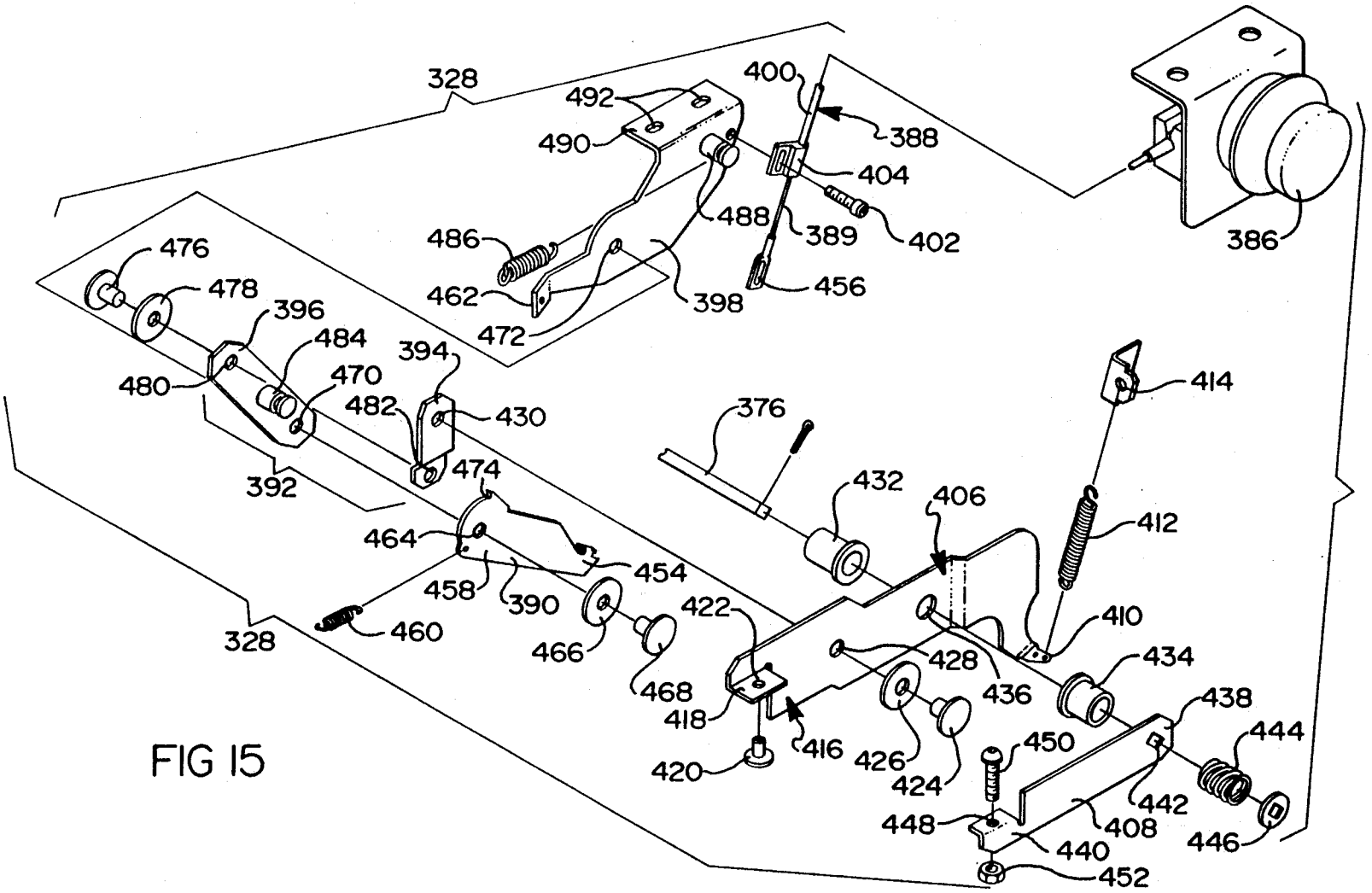
FIG. 15 is an exploded perspective view of the various components associated with the push-button recliner assist mechanism of the present invention.

As best seen in FIG. 15, drive bracket 408 is shown to include a first end portion 438 and a second end portion 440. First end portion 438 includes a square-shaped opening 442 through which a portion of square drive rod 376 extends. In this manner, drive rod 376 is secured to drive bracket 408 for direct rotation therewith. A portion of drive rod 376 also extends through a second coil spring 444, which is retained over an end portion of drive rod 376 via a retainer clip 446 and a fastening member, such as a cotter pin or the like. Second end portion 440 of drive bracket 408 includes a threaded aperture 448 through which a threaded adjusting screw 450 extends. Adjusting screw 450 is also retained on second end portion 440 via a threaded nut 452, thereby enabling threaded adjusting screw 450 to be adjustably located at a predetermined position with respect to grommet 420 supported on drive assist bracket 406.

With continued reference to FIGS. 15 through 18, a first end portion 454 of actuator bracket 390 is shown coupled to an end portion 456 of cable 388. A second end portion 458 of actuator bracket 390 is coupled to a third coil spring 460 which is, in turn, coupled to a leg 462 of base bracket 398. As noted, actuator bracket 390 is pivotally coupled about pivot point 391 to second link member 396 of cocking linkage assembly 392 and to base bracket 398. More particularly, a rivet 468 extends through washer 466, aperture 464 in actuator brackets 390, aperture 470 of second link member 396, and aperture 472 formed in base bracket 398 to define pivot point 391. Moreover, a shoulder portion 474 formed on actuator bracket 390 acts on an edge surface of second link member 396 for pivotably moving second link member 396 in response to axial movement of cable 388.

In accordance with a preferred construction of the present invention, first and second link members 394 and 396 define an "over-center" locking mechanism. Link members 394 and 396 are pivotally coupled about a central pivot point 475 via a rivet 476, washer 478, and apertures 480 and 482 formed in second and first link members 396 and 394, respectively. Second link member 396 further includes a boss portion 484 having a groove extending circumferentially therearound which retains one end of a fourth coil spring 486 thereon. The other end of fourth coil spring 486 is similarly adapted to be coupled to a circumferential groove extending around a boss portion 488 of base bracket 398. Base bracket 398 is adapted to be fixedly secured to wooden side frame member 348 via shoulder portion 490 and elongated openings 492 through which threaded screws or the like may be inserted.

Figure 16:
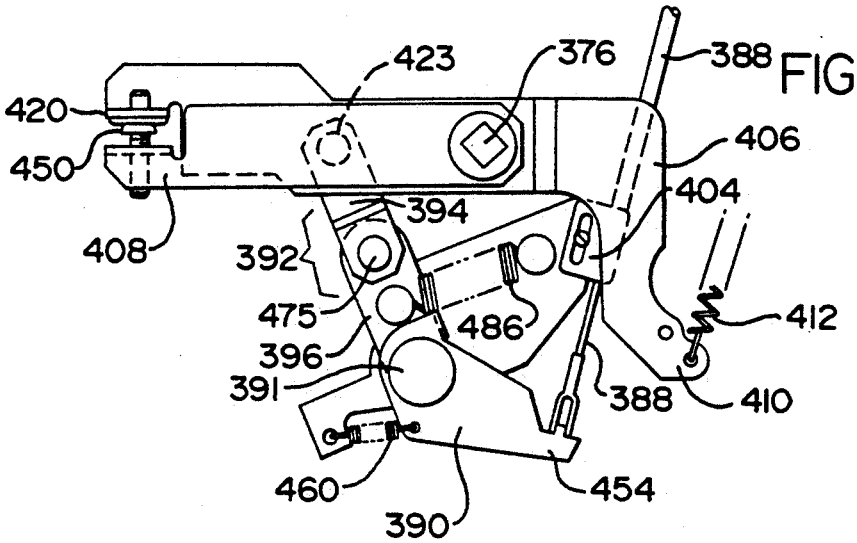
FIG. 16 is a side view of the recliner assist mechanism of the present invention in the "locked" position it assumes when the leg assembly is fully retracted.
Figure 17:
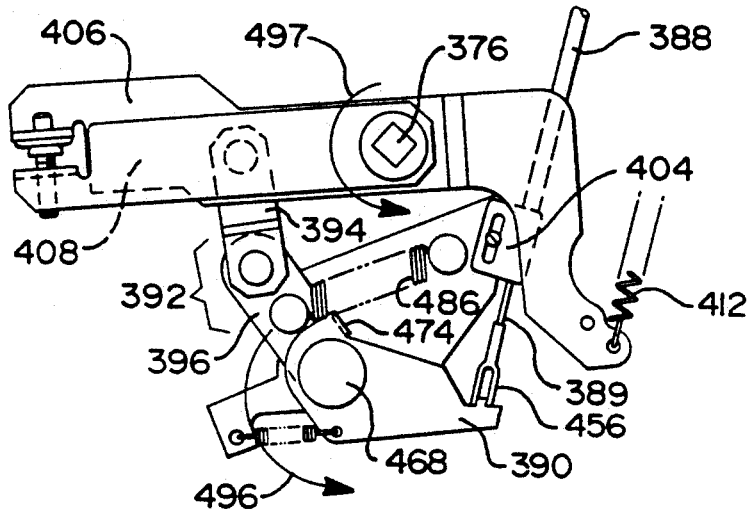
FIG. 17 is a side view, similar to FIG. 16, showing the positions of the various components associated with the recliner assist mechanism as it is initially activated for causing the leg rest assembly to move toward its extended position.
Figure 18:
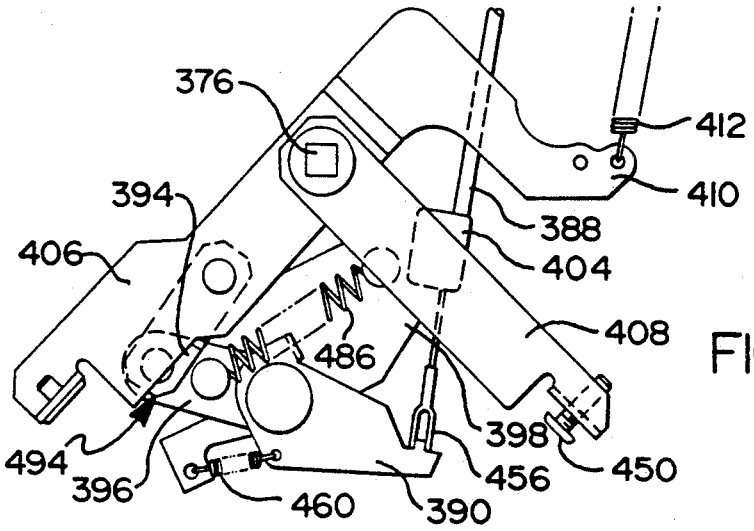
FIG. 18 is a side view, similar to FIG. 16, showing the mechanism in a fully "unlocked" position when the leg rest assembly is extended and the seat assembly is in its forward tilted position.

With particular reference now to FIGS. 16 through 18, a detailed description of the operation of the recliner assist mechanism 328 will be provided. In general, recliner assist mechanism 328 operates to initiate extension of pantograph linkage assemblies 156, and thus leg rest frame board 154 (FIG. 14), as well as initiation of forward movement of seat assembly 314 from its "upright" position to its "tilted" position. More specifically, FIG. 16 shows recliner assist mechanism 328 in an orientation it assumes when leg rest assembly 18 is fully retracted and seat assembly 314 is in its rear "upright" position. In this condition first coil spring 412 is operable to exert a maximum tensioning force on first end portion 410 of drive assist bracket 406. As such, first coil spring 412 tends to drive assist bracket 410 in a counterclockwise manner about drive rod 376. Concurrently, fourth coil spring 486 is exerting a minimum tensioning force in holding first and second link members 394 and 396 of cocking linkage assembly 392 in a "locked" position. When in the "locked" position, cocking linkage assembly 392 may assume either a generally straight "in line" orientation, as generally shown in FIG. 16, or a slightly "over-center" orientation, with pivot point 475 of cocking linkage assembly 392 being located slightly inwardly relative to drive rod 376. As will be appreciated, coil spring 460 is also under minimum tension while operating to hold first end portion 454 of actuator bracket 390, and thus cable 388, taut to remove any slack therein.

With reference to FIG. 17, upon the seat occupant selectively depressing push-button switch 386 (FIGS. 13 and 15), cable 388 is axially displaced or drawn upwardly, (i.e. preferably by approximately 0.5 inches) thus causing actuator bracket 390 to move pivotally in a counterclockwise direction (i.e. as indicated by directional arrow 496). Such counterclockwise movement of actuator bracket 390 causes shoulder portion 474 to forcibly urge second link member 396 to pivot about pivot point 391 in a counterclockwise direction against the biasing force of fourth coil spring 486 and third coil spring 460. Thus, central pivot point 475 between first and second link members 394 and 396, respectively, is rearwardly displaced out of longitudinal alignment or "over-center" alignment thereby "unlocking" cocking linkage assembly 392. In this condition, drive assist bracket 406 is able to freely pivot in a counterclockwise direction about drive rod 376. Therefore, the relatively large tensioning force provided by first coil spring 412 acts to urge drive assist bracket 406 to pivot in a counterclockwise direction about drive rod 376 which cause corresponding pivotable movement of drive bracket 408 and, in turn, drive rod 376 (see directional arrow 497).

With reference to FIG. 18, as drive assist bracket 406 is pivoted in a counterclockwise direction in response to the tensioning force of first coil spring 412, first and second link members 394 and 396 are pivotally urged into a partially folded orientation against the biasing force of fourth coil spring 486. As will be appreciated, coil spring 412 is sized to provide sufficient tension loading to cause drive assist bracket 406 to be rotated counterclockwise along a generally arcuate path to initiate and continue rotation of drive rod 376 until the counteracting over-center biasing force provided by coil springs 214 of toggle linkage assemblies 142 has been overcome. Moreover, first coil spring 412 is of a length and construction to enable it to exert a relatively large tensioning force on drive assist bracket 406 which is sufficient to cause drive assist bracket 406 to rotate drive bracket 408 and drive rod 376 against the counteracting force generated by coil springs 214. Furthermore, once drive assist bracket 406 has caused sufficient movement of drive bracket 408 and drive rod 376 past the "over-center" point of C-shaped toggle links 208, coil springs 214 are able to exert a counterclockwise driving force on drive rod 376 to thereby assist in continuing the counterclockwise rotation of drive rod 376.

As previously described, this action urges leg rest assembly 18 to a fully extended position in a relatively smooth and continuous fashion. However, it is contemplated that in recliner mechanisms which do not include rearwardly raised tracks for assisting (i.e. gravity) in leg rest extension and seat assembly tilting movement, a stronger coil spring 412 may simply be required to initiate these movements.

In general, assist mechanism 328 causes sufficient angular movement of drive rod 376 about its axis to result in corresponding movement of various linkage mechanisms driven by or drivingly coupled to drive rod 376. As previously described, such movement of these various linkage mechanisms permits extension of leg rest pantograph assemblies 156 via spring-assisted toggle linkage assemblies 142, and "tilting" movement of seat assembly 314 via operatively releasing bracket linkage assemblies 118 and tilt linkage assemblies 504 to permit seat assembly 314 to roll forward in tracks 316 and 318. Accordingly, only minimal physical effort (i.e. depressing switch 386), is required to initiate extension of leg rest pantographs 156. While recliner mechanism 312 is shown with a hand lever actuator in addition to push-button recliner assist mechanism 328, it will be appreciated that recliner assembly 312 could be provided with either independently, or with both as shown, depending on the preference of the end user.

Chairs embodying recliner mechanisms, of the type such as recliner mechanisms 10 or 312 are particularly suited for use with push-button recliner assist mechanism 328. This is due, in part, to the fact that recliner mechanisms 10 and 312 have the rearward portion of their curved tracks raised to store energy for extending leg rest assemblies 156 and simultaneously moving the seat assembly (i.e. or carriage) from its upright to its forward-tilted position when the seat assembly is permitted to roll forward in the tracks.

In accordance with another unique feature of recliner mechanism 312, upper stabilizer rail 350 is shown to include a stop bracket 378 fixedly secured thereto that extends generally forwardly therefrom in a generally horizontal plane. Stop bracket 378 has a transverse end surface 379 that is adapted to make abutting contact with an adjustable locator member 380. Adjustable locator member 380 is secured to a flanged bracket 382 mounted to front bottom frame rail 330. In general, locator member 380 is a stop screw that is adjustable with respect to bracket 382 and which is secured thereto via a wing nut 384. In operation, once drive rod 376 is released from its "locked" position, the entire seat assembly 314 and side frame members 346 and 348 move concurrently along tracks 316 and 318 via wheel units 499 of tilt linkage assemblies 504. Therefore, upper stabilizer rail 350 also moves toward locator member 380 and flange bracket 382 until end surface 379 of stop bracket 378 comes into contact with adjustable locator member 380. This adjustable feature is operable to control the forward movement of seat assembly 314 and side frame members 346 and 348 and, in turn, controls the amount of extension of pantograph linkages 156. As noted, the position of locator member 380 with respect to end 379 of stop bracket 378 can be selectively adjusted to cause corresponding adjustment of the "angle of inclination" and "height" for leg rest frame board 154. The maximum inclination angle and height is defined by leg rest assembly 18 being allowed to travel to its "fully" elevated position In the "fully" extended position, C-shaped toggle links 208 are biased by spring 214 to assume a fully over-center position relative to drive rod 376, to thus provide a maximum force operable to maintain leg rest assembly 18 in the "fully" extended position.

As will be appreciated, a lower inclination angle for leg rest board 152 will make it easier for a seat occupant to retract leg rest assembly 18. Conversely, when leg rest frame board 152 is at its "fully" elevated position it is more difficult to initiate retraction of leg rest assembly 18 since the seat occupant must displace or "break" spring-assisted toggle linkage assemblies 142 from their fully over-center position. Therefore, by controllably inhibiting C-shaped toggle links 208 from moving to their fully over-center position, the tensioning force exerted by coil springs 214 can be controlled so as to adjustably vary the amount of downward force which must be exerted by the legs of the seat occupant to initiate retraction of leg rest assembly 18. Accordingly, the amount of effort needed to begin retraction of leg rest frame board 152 can be controllably adjusted in accordance with the inclination angle and height desired by the seat occupant. This feature is particularly advantageous for individuals of limited leg strength such as elderly and/or handicapped individual.

An additional degree of leg rest adjustability is provided by the two eyelet screws 215 and wing nuts 217 of toggle linkage assemblies 142. More particularly, wing nuts 217 enable the tension loading of coil springs 214 to be controllably adjusted to thus increase or decrease the amount of "assist" developed for driving leg rest assembly 18 between its "stored" (i.e. retracted) position and an extended position (as defined by the location of stop bracket 380 relative to locator screw 382). For example, by tightening wing nuts 217 more tension is produced in coil springs 214 thus generating a quicker, more positive "assist" characteristic upon movement of leg rest 18. Conversely, unscrewing of wing nuts 217 serves to adjustably reduce the tension force in coil springs 214 thereby slowing down or reducing the amount of "assist" provided to move leg rest assembly 18.

As will now be apparent, the various aforementioned modes of adjustability for recliner mechanism 312 are substantially coactive so as to permit customized adjustment. This is particularly advantages in articles of furniture such as sofa 300 having at least two independent reclinable seat units 302 and 304. More particularly, the amount of "assist" developed by toggle linkage assemblies 142 for each leg rest assembly 18 and/or the desired leg rest "inclination" and "height" can be individually adjusted to fit the particular needs of two distinct individuals.

As in all reclining mechanisms, there is a certain amount of fabric drag or friction between the moveable upholstered seat unit and the outer frame upon activation of the recliner. As such, gravity tends to provide greater assistance to a heavier seat occupant in pulling seat assembly 314 down tracks 316 and 318 so as to more easily overcome such drag forces. However, a lighter weight seat occupant is required to exert a more deliberate effort for overcoming the frictional drag forces to generate the reclining movement. Thus, a greater spring force in coil springs 214 acts to assist the lighter weight seat occupant in overcoming the drag characteristics. By the same token, in order for the lighter weight seat occupant to overcome the increased spring tension when attempting to retract leg rest frame board 152, the lighter weight seat occupant can also adjust the "inclination" of leg rest frame board 152 downwardly from the "fully" extended position. In this manner, the lighter weight seat occupant is not required to overcome the increased spring tension of coil springs 214 for "breaking" over the over-center position of toggle linkage 142. As such, retractive movement of leg rest board 152 and, in turn, leg rest pantographs 156 toward the stowed position is relatively easy and extremely smooth.

Still yet another degree of adjustability is provided by variably adjusting the length of adjusting screw 450 supported from drive bracket 408. By threadably adjusting screw 450, the preloading of drive bracket 408 can be adjusted while recliner assist mechanism 328 is in the "locked" position, thus making drive bracket 408 more easily urged into movement by drive assist bracket 406 via actuation of button actuator 386.

Figure 19:
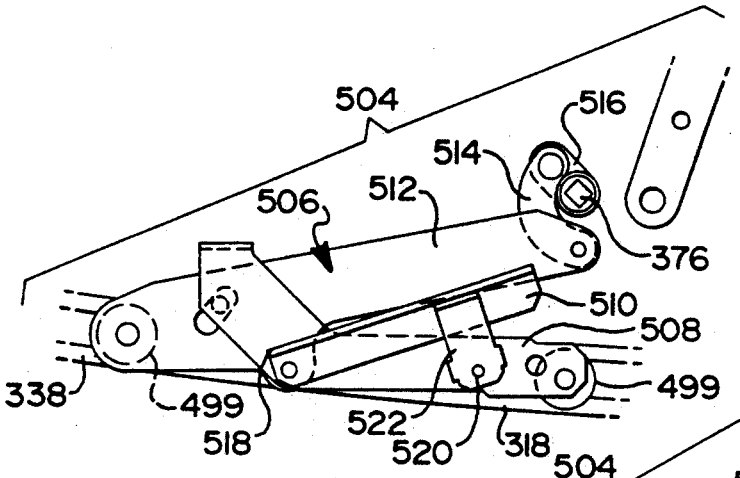
FIGS. 19 and 20 are side views of the tilt linkage assemblies incorporated into the recliner mechanism of FIG. 13 shown in "locked" and "released" positions, respectively.
Figure 20:
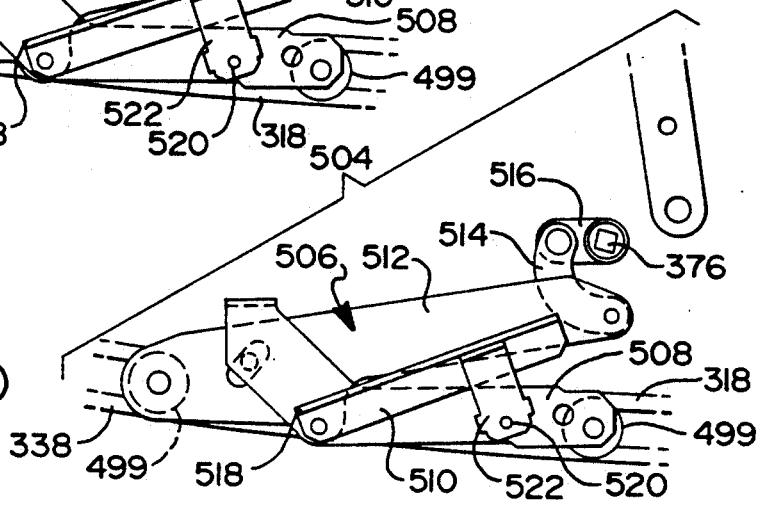

With reference now to FIGS. 19 and 20, tilt linkage assembly 504 of the present invention incorporating a pivot lever 506, a connector link 508 and an intermediate bracket 510 is shown in greater detail. One end 512 of pivot lever 506 is pivotally coupled to one end of a C-shaped toggle link 514. The opposite end of C-shaped toggle link 514 is, in turn, pivotally coupled to a connector link 516 which is fixedly secured to the drive rod 376. The length of connector link 516 is largely responsible for the amount of angular "tilting" movement of seat assembly 314. In addition, a rear end portion 518 of intermediate link 510 is pivotally coupled with an end portion 520 of connector link 508.

The primary difference between the tilt linkage assembly 504 of the present invention and tilting linkages 136 of recliner mechanism 10 is that intermediate link 510 includes a riser bracket 522 that acts to adjust the orientation of intermediate bracket 510 relative to connector link 508. This orientation adjustment is necessary due to the difference in height between the front and the back of tracks 316 and 318. In addition, front wheel 499 of each tilt linkage assembly 504 is mounted in a slightly different location than that on bearing link assemblies 26 to also accommodate the height difference of the tracks. As reclinable seating unit 302 begins to move forwardly, C-shaped connecting link 514 is rotated in a counter clockwise manner when viewing FIGS. 19 and 20. This movement causes pivot lever 506 to begin moving forwardly and downwardly relatively to drive rod 376. Concurrently, intermediate bracket 510 pivots at its rear end portion 518, and also at a pivot point 520. Accordingly, rear end portion 518 of the intermediate bracket 506 pivots slightly downwardly to "tilt" the seat back of seat assembly 314 downwardly relative to the front of the seat member as seating assembly 314 moves down tracks 316 and 318 toward its forward-tilted position. Thus, tilt linkage assemblies 504 serve to prevent seat assembly 314 from changing its orientation appreciably as it is moved from the elevated rear end portions 336 and 338 of tracks 316 and 318, respectively, to the lowered front end portions while performing the "tilting" function of the three-way recliner mechanism.

Figure 21:
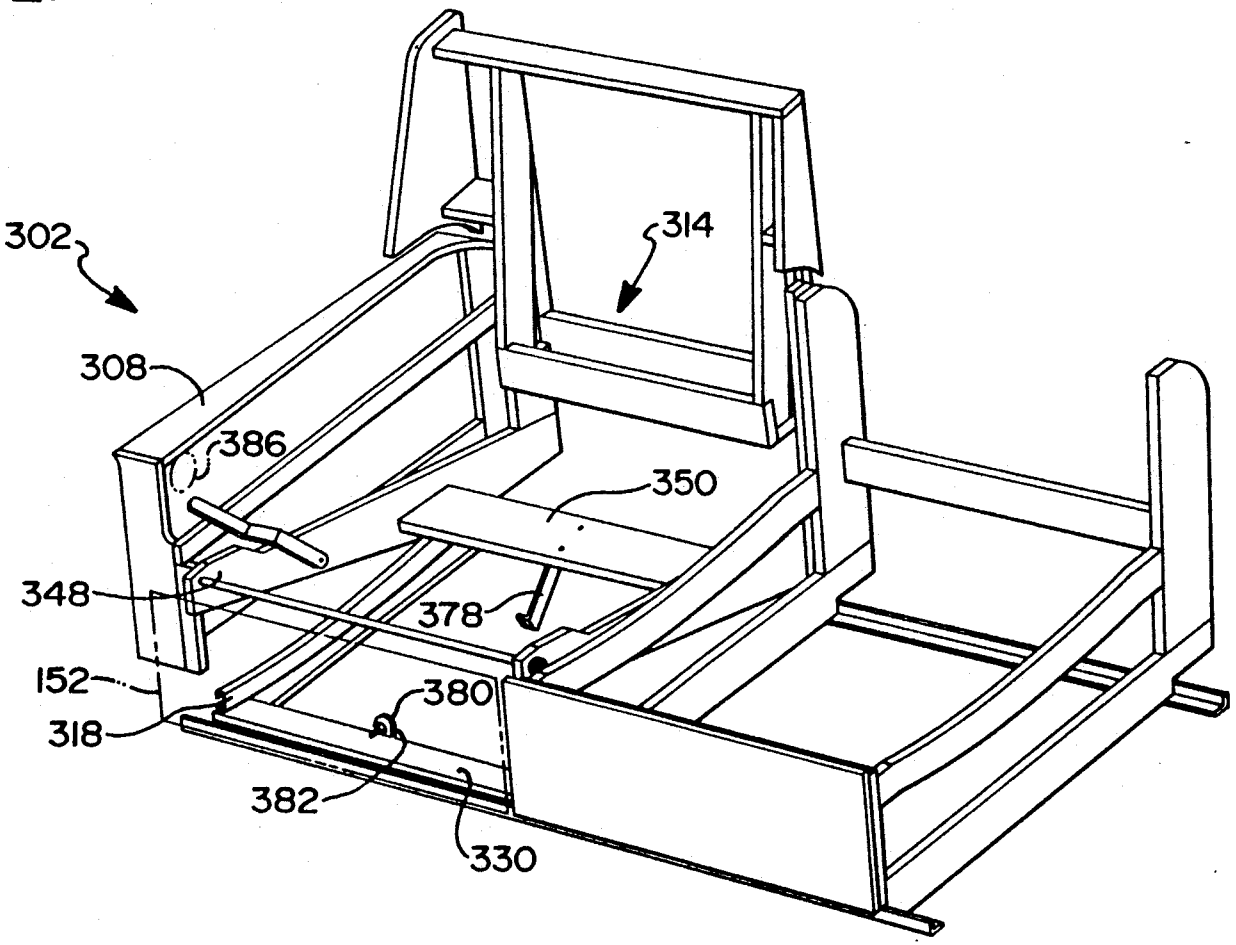
FIG. 21 is a perspective view of a portion of still another preferred embodiment for the modular sofa of FIG. 12, the moveable frame assembly and recliner mechanism of the present invention (with upholstery and various other parts removed, and which is partially disassembled for clarity) showing the leg rest assembly in its retracted position.
Figure 22:
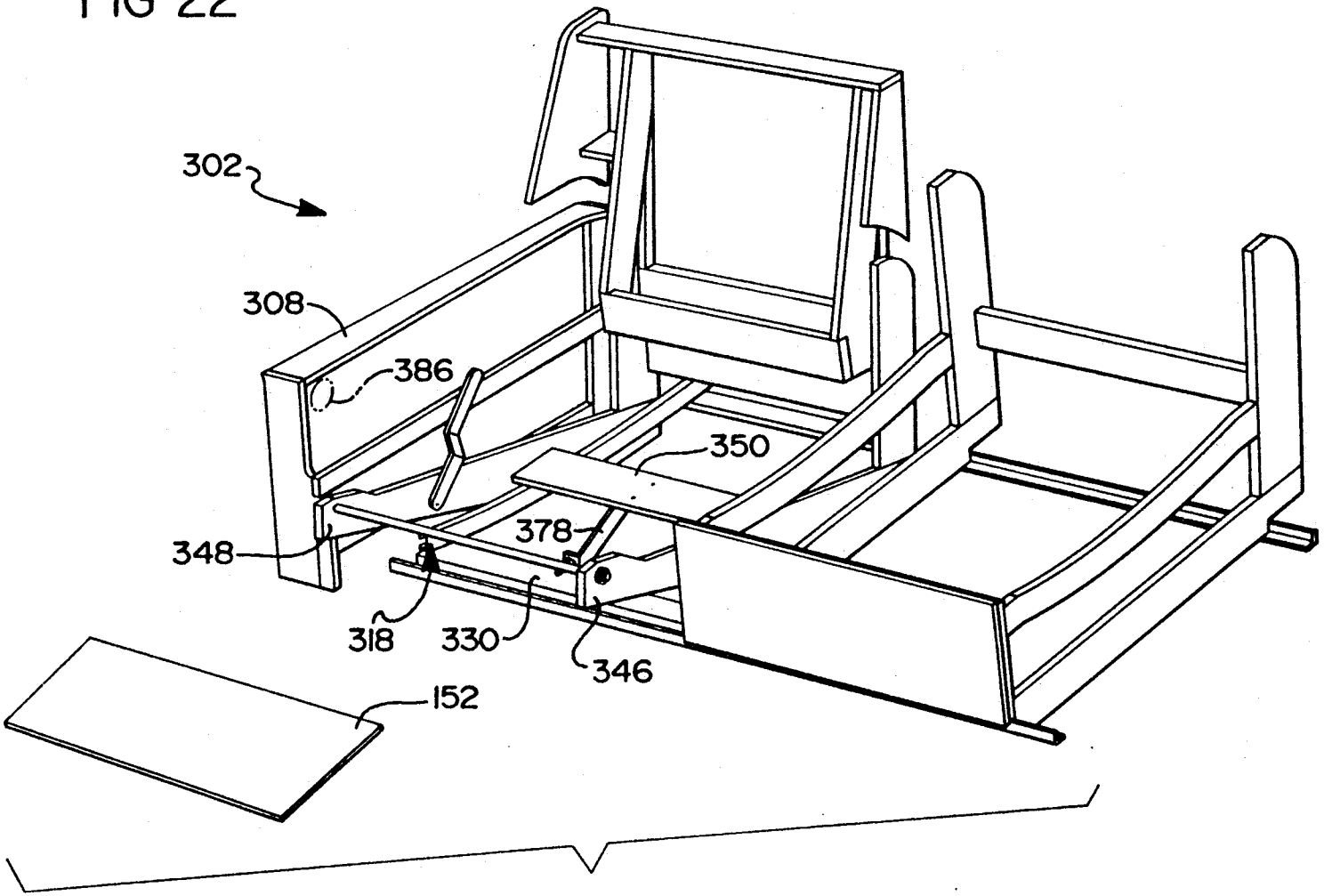
FIG. 22 is a perspective view of the frame assembly and recliner mechanism of FIG. 21 showing the leg rest assembly and moveable frame assembly in their fully forward positions.

With reference to FIGS. 21 and 22, additional illustrations of reclinable seat unit 302 can be seen. In FIG. 21, reclinable seat unit 302 is shown with leg rest frame member 154 thereof in a fully retracted position. In FIG. 22, it can be seen that side arm portion 308 of seat unit 302 moves concurrently outwardly with recliner mechanism 312 as extending action of leg rest member 152 is initiated. The "travelling side body" movement of outer arm 308 or "side body" of a loveseat or sofa along with seating assembly 314 as it moves between its standard "upright" to its "forward-tilted" positions provides an aesthetically pleasing and functional appearance that is frequently desired in sofas and loveseats. It should be noted that in such an embodiment, push-button release switch 386 can be located on moving outer arm 308 so that there is no relative movement between push-button release switch 386 and the rest of recliner assist mechanism 328 as seat assembly 314 and assist mechanism 328 move forwardly along tracks 316 and 318.

From FIG. 22 it can also be seen that stop bracket 378 comes into abutting contact with locator screw 380 to halt forward extending travel of leg rest frame board 152 at a predetermined point of travel. It will be appreciated, however, that reclinable seat unit 302 could be readily configured to enable recliner mechanism 312 to move independently of arm portion 308, and other frame-like members of the recliner chair 302, if so desired.

The foregoing discussion discloses and describes an exemplary embodiment of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A manually-actuated assist mechanism for use in a seat unit for initiating the extension of a leg rest assembly, said leg rest assembly including a leg rest frame board, pantograph linkage means coupled to said leg rest frame board for controllably moving said leg rest frame board between retracted and extended positions, and drive means coupled to said pantograph linkage means for movement between a locked position wherein said leg rest frame board is in said retracted position and a released position for permitting movement of said leg rest frame board toward said extended position, said manually-actuated assist mechanism comprising:

first bracket means for urging said drive means rotationally, said first bracket means being coupled to said drive means and moveable between a first position when said drive means is in said locked position and a second position corresponding to when said drive means is in said released position;

over-center linkage means moveable from a first over-center position for releasably maintaining said first bracket means in said first position and a second over-center position for releasing said first bracket means for movement to said second position;

biasing means for urging said first bracket means toward said second position, said biasing means also being operable to initiate movement of said leg rest assembly toward said extended position when said first bracket means is in said second position;

an actuating bracket operable to engage said over-center linkage means;

release means adapted to be engaged by a hand of an occupant of said seat unit for allowing said seat occupant to initiate extension of said leg rest assembly; and cable means responsive to said release means for causing said actuating bracket to urge said over-center linkage means to said second over-center position, said biasing means then urging said first bracket means rotationally to help rotationally drive said drive means to said second position.

2. The seating unit of claim 1 further including second bracket means having first and second ends and being pivotally associated with said first bracket means, said second bracket means being biased by said biasing means whereby said second bracket means is operable to rotate said first bracket means and thus said drive means when said over-center linkage means is urged to said second over-center position by said actuator bracket in response to a seat occupant selectively actuating said release means, said rotatable movement of said drive means being operable to extend said pantograph linkage means to thereby cause said leg rest frame board to move to said extended position.

3. The seating unit of claim 2 further comprising adjustable means operatively associated with said first bracket means and said second bracket means for variably adjusting the biasing force of said biasing means acting to urge said first bracket means and said drive means into rotational movement.

4. The seating unit of claim 2 further comprising second adjustable means for limiting extension of said pantograph linkage means as said pantograph linkage means is urged toward said extended position for varying the inclination angle of said leg rest frame board.

5. The seating unit of claim 2 wherein said release means comprises cable means operatively associated with said actuator bracket and means for causing said cable means to pivotably move said actuating bracket for selectively moving said over-center linkage means to said second over-center position.

6. The seating unit of claim 2 wherein said release means comprises cable means operatively associated with said actuator bracket and push-button means for causing said cable means to pivotably move said actuating bracket for selectively moving said over-center linkage means to said second over-center position.

7. The seating unit of claim 6 wherein said push-button means comprises a manually depressible push-button switch operable to cause said cable means to pivotally rotate said actuator bracket through a predetermined range of motion.

8. The seating unit of claim 6 wherein said release means for causing said cable means to pivotably move said actuating bracket comprises a manually operable mechanism adapted to cause said cable means to pivotally rotate said actuator bracket through a predetermined range of motion.

9. A seating unit for use in an article of furniture of the type having a frame section within which said seating unit is secured, said seating unit comprising:

a seat assembly having a seat member and a seat back;

a leg rest assembly supported for movement between a retracted position and an extended position;

drive means operatively connected to said leg rest assembly for urging said leg rest assembly into said extended position, said drive means being moveable between a locked position wherein said leg rest assembly is releasably retained in said retracted position and a released position wherein said leg rest assembly is permitted to move toward said extended position; and manually-operated assist means for permitting a seat occupant to selectively cause said drive means to move from said locked position to said released position and initiate movement of said leg rest assembly toward said extended position, said assist means comprising:

bracket means for urging said drive means rotationally upon actuation of said manually operated assist means, said bracket means being coupled to said drive means and moveable between a first position when said drive means is in said locked position and a second position when said drive means is in said released position;

biasing means for urging said bracket means toward said second position, said biasing means being operationally coupled to said bracket means and a portion of said seat assembly;

linkage means for releasably maintaining said bracket means in said first position in opposition to said biasing means;

actuation means adapted to be manipulated by a hand of said seat occupant for allowing said seat occupant to initiate movement of said leg rest assembly; and cable means responsive to said actuation means for moving said linkage means in response to manipulation of said actuation means by said seat occupant to cause said biasing means to move said bracket means to said second position, whereby said drive means is moved to said released position for releasing said leg rest assembly for movement toward said extended position.

10. The seating unit of claim 9 wherein said linkage means is an over-center linkage assembly moveable between said locked position for releasably retaining said bracket means in said first position and an unlocked position for releasing said bracket means for movement toward said second position.

11. The seating unit of claim 10 wherein said actuation means comprises a pivotable actuating bracket which is adapted to act on said over-center linkage assembly, said cable means being operatively coupled to said actuator bracket, and release means for selectively actuating said cable means for causing sufficient pivotable movement of said actuating bracket to move said over-center linkage assembly to said unlocked position.

12. The seating unit of claim 11 wherein said bracket means includes a first bracket member mounted for direct movement with said drive means and a second bracket member pivotably coupled to said first bracket member, said second bracket member being biased by said biasing means such that said second bracket member is operable to concurrently move said first bracket member and said drive means when said over-center linkage assembly is urged to said unlocked position by the cooperative movement of said cable means and said actuator bracket, whereby said movement of said drive means to said released position is operable to release said leg rest assembly for movement toward said extended position.

13. The seating unit of claim 4 wherein said release means is remotely located and operably associated with said cable means such that deliberate actuation of said release means causes said cable means to pivot said actuating bracket so as to move said over-center linkage assembly to said unlocked position.

14. The seating unit of claim 12 wherein said release means is a remotely located push-button member operably associated with said cable means such that deliberate depression of said push-button member causes said cable means to pivot said actuating bracket so as to move said over-center linkage assembly to said unlocked position.

15. The seating unit of claim 12 further comprising second biasing means coupled to said over-center linkage assembly for generating a biasing force operable to draw said over-center linkage assembly into said locked position when said leg rest assembly is returned by said seat occupant from said extended position to said retracted position.

16. The seating unit of claim 15 further comprising third biasing means for biasing said actuator bracket in a direction opposing pivotable movement thereof upon actuation of said release means.

17. The seating unit of claim 12 further comprising adjustment means operatively associated with said first and second bracket members for permitting selective adjustment of the biasing force exerted by said biasing means.

18. The seating unit of claim 17 further comprising support means for supporting said seat assembly for translational and tilting movement between an upright position and a tilted position, said seat assembly being in said upright position when said leg rest assembly is in said retracted position and in said tilted position when said leg rest assembly is in said extended position, said seat assembly being operatively coupled to said drive means such that selective actuation of said actuation means causes substantially concurrent movement of said seat assembly to its tilted position and said leg rest assembly to its extended position.

19. The seating unit of claim 18 further comprising:

second linkage means operative for releasably retaining said drive means in said locked position, said second linkage means being moveable between a first position for releasably locking said drive means in said locked position and a second position for moving said drive means to said released position; and third linkage means operable for biasingly retaining said leg rest assembly in said retracted position when said drive means is in said locked position and for biasingly driving said leg rest assembly toward said extended position when said drive means is in said released position;

said second linkage means being moved to said second position and said third linkage means acting to drive said leg rest assembly toward said extended position in response to said actuation means causing movement of said linkage means to said unlocked position.

20. The seating unit of claim 19 further comprising:

second adjustment means coactive with said third linkage means for permitting said seat occupant to variably adjust the biasing resistance acting on said leg rest assembly upon movement thereof between said extended position and said retracted position.

21. The seating unit of claim 19 further comprising:

second adjustment means coactive with said seat assembly and said frame section for permitting said seat occupant to variably adjust the angle of inclination of said leg rest assembly with a range defined between said retracted position and a fully extended position.

22. The seating unit of claim 21 wherein said second adjustment means includes stop means for selectively inhibiting forward movement of said seat assembly when said seat assembly is released for movement toward said tilted position such that said stop means inhibits extension of said leg rest assembly to said fully extended position.

23. The seating unit of claim 19 further comprising:

second adjustment means coactive with said third linkage means for permitting said seat occupant to variably adjust the biasing resistance acting on said leg rest assembly upon movement thereof between said extended position and said retracted position; and third adjustment means coactive with said seat assembly and said frame section for permitting said seat occupant to variably adjust the angle of inclination of said leg rest assembly with a range defined between said retracted position and a fully extended position.

24. The seating unit of claim 23 further comprising:

tilt linkage means operatively coupling said support means to said drive means for causing tilting movement of said seat assembly toward said tilted position when said drive means is in said released position, said tilt linkage means being operable for assisting said second linkage means in releasably locking said seat assembly in said upright position when said drive means is in said locked position;

said support means having a pair of wheel means disposed for rolling movement within stationary track means and having pivot link means upon which one of said pair of wheel means is mounted, said pivot link means interconnecting said support means to said tilt linkage means and being operable to tilt a portion of said seat assembly relative to said one of said pair of wheel means when said tilt linkage means is moved in response to movement of said drive means; and said drive means including a transverse rotatable drive rod and said manually operated assist means being operatively connected to said drive rod for rotating said drive rod through a predetermined and limited angle to sufficiently move said second linkage means for permitting actuation of said tilt linkage means and said third linkage means in response to selection actuation of said release means.

25. The seating unit of claim 24 wherein said third linkage means includes a toggle lever secured directly to said drive rod for rotation therewith, said toggle lever being pivoted to a first leg of a C-shaped toggle link which curves around and below said drive rod and which has a second rear leg, and wherein said second adjustment means includes spring means secured between a portion of said seat assembly rearward of said toggle link and said second leg, whereby said spring means urges said drive rod to rotate in on direction for biasingly urging said leg rest assembly toward its retracted position when a pivot connection between said toggle lever and said front leg of said toggle link moves over an over-center position, and wherein said spring means acts to urge said drive rod to rotate in an opposite direction to biasingly drive said leg rest assembly toward its extended position when said pivot connection between said toggle lever and said front leg of said toggle link moves over said over-center position, said second adjustment means further including tensioning means for adjusting the biasing force exerted by said spring means so as to selectively vary the rate of retractive and extension movement of said leg rest assembly.

26. The seating unit of claim 24 wherein said third adjustment means includes stop means for selectively inhibiting forward movement of said seat assembly when said seat assembly is released for movement toward said tilted position such that said stop means inhibits extension of said leg rest assembly to said fully extended position.

27. A seating unit for use in an article of furniture having a frame section within which a seating unit is secured for longitudinal and angular movement therein, said seating unit comprising:

track means secured to a base within said frame section;

a seat assembly having a seat member, a seat back;

support means supporting said seat assembly for translational and tilting movement on said track means between a rear-upright position and a forward-tilted position;

a leg rest assembly supported for movement with said support means between a retracted position when said seat assembly is in said rear-upright position and an extended operative position when said seat assembly is in said forward-tilted position;

drive means for operatively connecting said support means and said leg rest assembly, said drive means being moveable between a locked position wherein said seat assembly is releasably retained in said rear-upright position and a released position for permitting said seat assembly to move toward said forward-tilted position;

first over-center linkage means for selectively moving said drive means between said locked and released positions, said first over-center linkage means being moveable between a first position for releasably locking said drive means in said locked position and a second position for moving said drive means to said released position;

tilt linkage means operatively coupling said support means to said drive means for causing tilting movement of said seat assembly toward said forward-tilted position when said drive means is in said released position, said tilt linkage means being operable for assisting said first over-center linkage means in releasably locking said support means in said rear-upright position when said drive means is in said locked position;

second over-center linkage means operatively coupling said leg rest assembly to said drive means and having spring means for biasingly retaining said leg rest assembly in said retracted position when said drive means is in said locked position and for biasingly driving said leg rest assembly toward said extended position when said drive means is in said released position;

manually operated actuation means for permitting a seat occupant to move said first over-center linkage means from said first position to said second position;

first adjustable means coactive with said spring means of said second over-center means for permitting said seat occupant to variably adjust the amount of spring biased assistance exerted by said spring means in moving said leg rest assembly between said retracted and extended positions; and second adjustable means for varying the amount of forward travel of said support means relative to said track means for causing corresponding adjustment to the angle of inclination of said leg rest assembly.

28. The seating unit of claim 27 wherein said second over-center linkage means includes a spring-assisted toggle linkage mechanism having a toggle lever directly connected for rotation with said drive rod, said toggle lever pivoted to a front leg of a C-shaped toggle link which curves around and below said drive means and which has a second rear leg, and said spring means is secured between a portion of said seat assembly rearward of said toggle link and said second rear leg, whereby said spring means urges said drive means to rotate in one direction for biasing said leg rest assembly toward its retracted position when said pivot connection between said toggle lever and said front leg of said toggle link is located below a line of center of said drive means, and wherein said spring means acts to urge said drive means to rotate in an opposite direction to forwardly drive said leg rest assembly toward its extended position when said pivot connection between said toggle lever and said front leg of said toggle link is located above said line of center of said drive means, and wherein said first adjustable means includes tensioning means operable for permitting adjustment of the tensioning force exerted on said leg rest assembly by said spring means.

29. The seating unit of claim 28 wherein said second adjustable means includes a stop bracket secured to and extending forwardly from said support means; and a locator member extending from a flange bracket secured to said frame section, the position of said locator member being adjustable relative to said stop bracket, said stop bracket being operable to move toward and into abutting contact with said locator member as said pantograph linkage means moves toward said extended position, said second adjustable means thus being operable to limit outward travel of said pantograph linkage means, to thereby limit the elevated extension of a leg rest member.

30. A seating unit of claim 28 wherein said drive means includes a transverse rotatable drive rod and said manually operated actuation means being operatively connected to said drive rod for causing rotation of said drive rod through a predetermined and limited angle so as to move said first over-center linkage means to said second position for permitting actuation of said tilt linkage means and said second over-center linkage means.

31. A seating unit for use in an article of furniture of the type having a frame section within which said seating unit is secured for longitudinal and angular movement therein, said seating unit comprising:

track means secured to a base within said frame section;

a seat assembly having a seat member, a seat back;

support means supporting said seat assembly for translational and tilting movement on said track means between a rear-upright position and a forward-tilted position;

a leg rest assembly supported for movement with said support means between a retracted position when said seat assembly is in said rear-upright position and an extended operative position when said seat assembly is in said forward-tilted position;

drive means for operatively connecting said support means and said leg rest assembly, said drive means being moveable between a locked position wherein said seat assembly is releasably retained in said rear-upright position and a released position for permitting said seat assembly to move toward said forward-tilted position;

first over-center linkage means for selectively moving said drive means between said locked and released positions, said first over-center linkage means being moveable between a first position for releasably locking said drive means in said locked position and a second position for moving said drive means to said released position;

tilt linkage means operatively coupling said support means to said drive means for causing tilting movement of said seat assembly toward said forward-tilted position when said drive means is in said released position, said tilt linkage means being operable for assisting said first over-center linkage means in releasably locking said support means in said rear-upright position when said drive means is in said locked position;

second over-center linkage means operatively coupling said leg rest assembly to said drive means and having spring means for biasingly retaining said leg rest assembly in said retracted position when said drive means is in said locked position and for biasingly driving said leg rest assembly toward said extended position when said drive means is in said released position;

manually operated actuation means for permitting a seat occupant to move said first over-center linkage means from said first position to said second position; and first adjustable means coactive with said spring means of said second over-center means for permitting said seat occupant to variably adjust the amount of spring biased assistance exerted by said spring means in moving said leg rest assembly between said retracted and extended positions.

32. The seating unit of claim 31 further comprising:

second adjustable means for varying the amount of forward travel of said support means relative to said track means for causing corresponding adjustment to the angle of inclination of said leg rest assembly.

33. The seating unit of claim 32 wherein said second adjustable means includes a stop bracket secured to and extending forwardly from said support means; and a locator member extending from a flange bracket secured to said frame section, the position of said locator member being adjustable relative to said stop bracket, said stop bracket being operable to move toward and into abutting contact with said locator member as a pantograph linkage means moves toward said extended position, said second adjustable means thus being operable to limit outward travel of said pantograph linkage means, to thereby limit the elevated extension of a leg rest member.

34. A seating unit for use in an article of furniture of the type having a frame section within which said seating unit is secured for longitudinal and angular movement therein, said seating unit comprising;

track means secured to a base within said frame section;

a seat assembly having a seat member, a seat back;

support means supporting said seat assembly for translational and tilting movement on said track means between a rear-upright position and a forward-tilted position;

a leg rest assembly supported for movement with said support means between a retracted position when said seat assembly is in said rear-upright position and an extended operative position when said seat assembly is in said forward-tilted position;

drive means for operatively connecting said support means and said leg rest assembly, said drive means being moveable between a locked position wherein said seat assembly is releasably retained in said rear-upright position and a released position for permitting said seat assembly to move toward said forward-tilted position;

first over-center linkage means for selectively moving said drive means between said locked and released positions, said first over-center linkage means being moveable between a first position for releasably locking said drive means in said locked position and a second for moving said drive means to said released position;

tilt linkage means operatively coupling said support means to said drive means for causing tilting movement of said seat assembly toward said forward-tilting position when said drive means is in said released position, said tilt linkage means being operable for assisting said first over-center linkage means in releasably locking said support means in said rear-upright position when said drive means is in said locked position;

second over-center linkage means operatively coupling said leg rest assembly to said drive means and having spring means for biasingly retaining said leg rest assembly in said retracted position when said drive means is in said locked position and for biasingly driving said leg rest assembly toward said extended position when said drive means is in said released position;

manually operated actuation means for permitting a seat occupant to move said first over-center linkage means from said first position to said second position; and first adjustable means for varying the amount of forward travel of said support means relative to said track means for causing corresponding adjustment to the angle of inclination of said leg rest assembly.

35. The seating unit of claim 34 wherein said second over-center linkage means includes a spring-assisted toggle linkage mechanism having a toggle lever directly connected for rotation with said drive rod, said toggle lever pivoted to a first leg of a C-shaped toggle link which curves around and below said drive means and which has a second rear leg, and said spring means is secured between a portion of said seat assembly rearward of said toggle link and said second leg, whereby said spring means urges said drive means to rotate in one direction for biasing said leg rest assembly toward its retracted position when said pivot connection between said toggle lever and said front leg of said toggle link is located below a line of center of said drive means, and wherein said spring means acts to urge said drive means to rotate in an opposite direction to forwardly drive said leg rest assembly toward its extended position when said pivot connection between said toggle lever and said front leg of said toggle link is located above said line of center of said drive means.

36. The seating unit of claim 35 wherein said first adjustable means includes a stop bracket secured to and extending forwardly from said support means; and a locator member extending from a flange bracket secured to said frame section, the position of said locator member being adjustable relative to said stop bracket, said stop bracket being operable to move toward and into abutting contact with said locator member as said pantograph linkage means moves toward said extended position, said locator member thus being operable to limit outward travel of said pantograph linkage means, to thereby limit the elevated extension of a leg rest member.

37. A seating unit of claim 35 wherein said drive means includes a transverse rotatable drive rod and said manually operated actuation means being operatively connected to said drive rod for causing rotation of said drive rod through a predetermined and limited angle so as to move said first over-center linkage means to said second position for permitting actuation of said tilt linkage means and said second over-center linkage means.

* * * * *

UNITED STATES PATENT AND TRADEMARK OFFICE

CERTIFICATE OF CORRECTION

PATENT NO. : 5,271,660

DATED : December 21, 1993

INVENTOR(S) : Larry P. LaPointe

It is certified that error appears in the above-indentified patent and that said Letters Patent is hereby corrected as shown below:

Column 5, line 3,
after "leg" insert --rest--.

Column 24, line 58, claim 13;

line 1, claim 25;
"4" should be --12--.

Column 30, line 15, claim 34;

line 24, claim 34;
after "second" insert --position--.

Column 30, lines 19,20, claim 34;

line 28, claim 34;
"forward-tilting" should be --forward-tilted--.

Signed and Sealed this

Seventh Day of June, 1994

Bruce Lehman

*Attest:*

BRUCE LEHMAN

*Attesting Officer*

*Commissioner of Patents and Trademarks*